US008250684B2

(12) United States Patent
Richardson et al.

(10) Patent No.: US 8,250,684 B2
(45) **Date of Patent: *Aug. 28, 2012**

(54) BABY BATH SINK INSERT

(75) Inventors: Benjamin Todd Richardson, Vancouver, WA (US); Kathryn A. Richardson, Vancouver, WA (US)

(73) Assignee: Puj, LLC, Vancouver, WA (US)

( * ) Notice: Subject to any disclaimer, the term of this patent is extended or adjusted under 35 U.S.C. 154(b) by 831 days.

This patent is subject to a terminal disclaimer.

(21) Appl. No.: 12/229,827

(22) Filed: Aug. 26, 2008

(65) Prior Publication Data

US 2009/0158521 A1 Jun. 25, 2009

Related U.S. Application Data

(63) Continuation-in-part of application No. 12/004,904, filed on Dec. 21, 2007.

(51) Int. Cl.
*A47K 3/024* (2006.01)

(52) U.S. Cl. ..... 4/572.1; 4/659; 4/578.1; 4/571.1; 4/579

(58) Field of Classification Search ..... 4/571.1, 4/659, 578.1, 579, 586, 581, 572.1; 5/93.1; 297/53, 16.2, 452.14, 452.12
See application file for complete search history.

(56) References Cited

U.S. PATENT DOCUMENTS

| | | | | | |
|---|---|---|---|---|---|
| 2,531,724 | A | * | 11/1950 | Cevasco | 4/572.1 |
| 3,162,864 | A | | 12/1964 | Ouellette | |
| 3,496,614 | A | * | 2/1970 | McGarry | 24/707.9 |
| 3,537,116 | A | * | 11/1970 | Kain | 5/420 |
| 3,744,483 | A | * | 7/1973 | Picolin | 601/28 |
| 4,785,486 | A | * | 11/1988 | Viesturs | 4/585 |
| 4,979,833 | A | * | 12/1990 | Cook | 383/12 |
| 5,297,300 | A | | 3/1994 | Sheu | |
| 2007/0022526 | A1 | | 2/2007 | Leach | |

OTHER PUBLICATIONS

International Preliminary Report on Patentability for International Patent Application No. PCT/US2008/012945, dated Jul. 1, 2010 (7 pgs).
International Search Report for Int'l appl. No. PCT/US08/012945; ISA/US; Jan. 22, 2009; 9 pages.

* cited by examiner

*Primary Examiner* — Gregory Huson
*Assistant Examiner* — Lauren Heitzer
(74) *Attorney, Agent, or Firm* — Ater Wynne LLP

(57) ABSTRACT

A baby bathing apparatus comprising an easily stored, relatively planar expanse of material configurable into a relatively concave configuration for deployment at least partially within a basin, and a method of forming the same. A material and configuration of a deployed bathing apparatus comfortably and securely retain a baby during bathing. One or more fastening means can be employed to securely yet detachably retain the expanse in a deployed configuration, while also allowing the bathing apparatus to resume a non-deployed, relatively planar configuration.

32 Claims, 7 Drawing Sheets

BABY BATH SINK INSERT

RELATED APPLICATIONS

The present application is a continuation-in-part of and claims benefit of priority from co-pending U.S. patent application Ser. No. 12/004,904 entitled BABY BATH SINK INSERT filed 21 Dec. 2007 and subject to common ownership herewith by Benjamin Todd Richardson and Kathryn A. Richardson, the disclosure of which is hereby incorporated herein in its entirety.

FIELD OF THE INVENTION

The invention relates generally to the field of baby care devices. More particularly, the invention relates to a baby-cradling insert that may be placed in a basin to aid bathing a baby, and a method of forming the same.

BACKGROUND OF THE INVENTION

Bathing babies is a basic care activity which presents numerous challenges to a parent or other caregiver. The choice of a bathing apparatus can mitigate some of these challenges.

For example, a baby must be securely yet gently supported throughout bathing. Particularly the baby's head must be supported during the months prior to the baby acquiring capability for self-support. Typically this requires the caregiver maintain an arm around the baby, leaving only one hand free to wash the baby. However, it can be difficult to simultaneously lift limbs and/or separate folds and to also scrub therein, under, or between.

Additionally, while many caregivers bathe babies in a washbasin (e.g., bathroom sink), washbasins typically comprise hard, cold, uncomfortable and unyielding surfaces which can be quite slippery when wet, presenting risks to a baby, not the least of which include accidental submersion, bruising, etc.

Numerous molded plastic bathtubs are available which include interior shapes configured to support a baby to some extent. However, such tubs are almost invariably relatively large and difficult to store when not in use, consuming substantial space and not having a size or shape configured to fit standard shelves, cabinet spaces, or other standard storage locations. Likewise, many such baby bathtubs comprise rigid materials that are slippery when wet, requiring a caregiver to support a baby with one hand throughout bathing. Additionally, many of the baby bathtubs advertised as 'baby sink baths' don't fit in a sink, and rather must be placed on a sink and/or adjacent countertop.

At least one collapsible miniature bathtub exists for bathing children, and is configured to hang within a standard bathtub, as described in U.S. Pat. No. 5,809,588. However, this collapsible tub still requires a caregiver to manually support the child during bathing, and also requires the caregiver to bend over and/or lift a baby from the tub at an awkward angle, which presents risks for musculoskeletal injuries to the caregiver.

A highly supportive, conformal, safe, and easy to store baby bathing apparatus is currently unknown in the art.

DETAILED DESCRIPTION OF THE PREFERRED EMBODIMENTS

Figure 1:
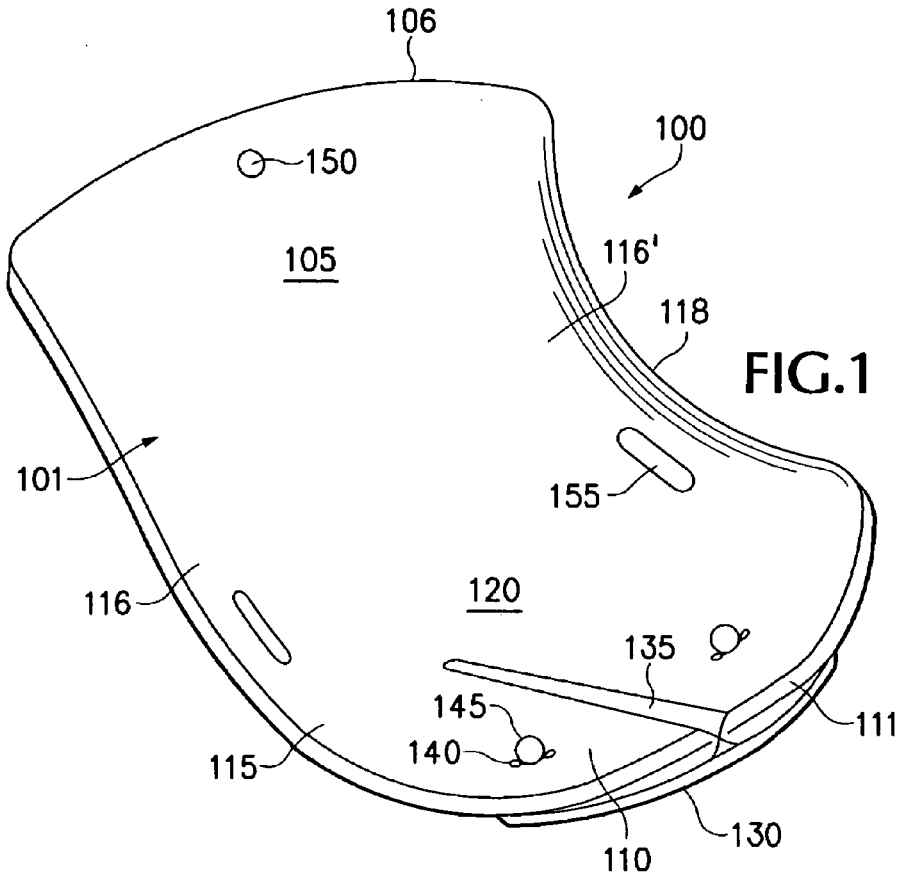
FIG. 1 depicts a isometric view of a baby bathing apparatus according to an embodiment of the invention.

Numerous terms are used herein for illustrative purposes, and are not intended to imply or impart any interpretive restrictions on the scope or nature of alternative embodiments of the invention. For example, the positional terms top, bottom, left, right, front, rear, inner, outer, and others may be used for clarity and/or comparison regarding a particular embodiment, but should not be construed to impart absolute requirements with regard to that or any other embodiment, or to limit the scope or nature of embodiments unless explicitly so stated herein.

Further, the qualifying terms relatively, substantially, approximately, and others appear throughout this description. These terms generally indicate that described structures, arrangements, features, assemblies, dimensions, ranges, characteristics, etc. may not, in a particular embodiment, be confined narrowly and exactly as described herein, but may also exhibit some variability within or around the stated range, dimension, etc. Such variation is frequently due to variability in manufacturing and/or assembly of materials, or may be inherent to the properties of a material, or due to environmental factors, or a combination thereof, (e.g., thermal expansion, hygroscopic absorption, etc.). Therefore, one having ordinary skill in the art would understand that the use of such terms does not denote indefiniteness of descriptions and/or claims in which they appear. Additionally, as alteration of one or more feature, characteristic, material, structure, etc., can affect the performance, response, behavior, etc. of other portions of an apparatus, one having ordinary skill in the art will recognize that the scope of the invented embodiments will in some instances exceed that explicitly described herein, without departing from the spirit of the invention.

Generally, the embodiments presented herein provide a three-dimensional baby bathing apparatus configurable from a relatively flat expanse of material. They feature a structurally supportive, yet flexible and compliant material having anti-slip surface properties even when wet. Therefore, a baby positioned therein is substantially cradled within a soft, secure, comfortable environment throughout a bathing process. Additionally, an embodiment of the invention is configured for placement within an existing wash basin (e.g., a sink) and to derive additional structural and positional support therefrom. The interposition of the invented bathing apparatus between the baby and the sink shelters the baby from the uncomfortable and potentially harmful aspects inherent in most installed and/or other such basins.

The configuration of the deployed bathing apparatus typically holds a baby, even a very young infant, in a stable orientation and position such that a caregiver can typically use both hands to bathe the baby, obviating the need to hold the baby with one hand and bathe it with the other. Generally, the apparatus holds a baby's legs, torso, and head in an elevated position relative to the baby's buttocks, with the buttocks held within the interior vertex of an inverted cone-like shape. Therefore, the baby's own movements are unlikely to upset such positioning, such as by causing the baby to slide downward or topple forward or sideways.

Figure 3:
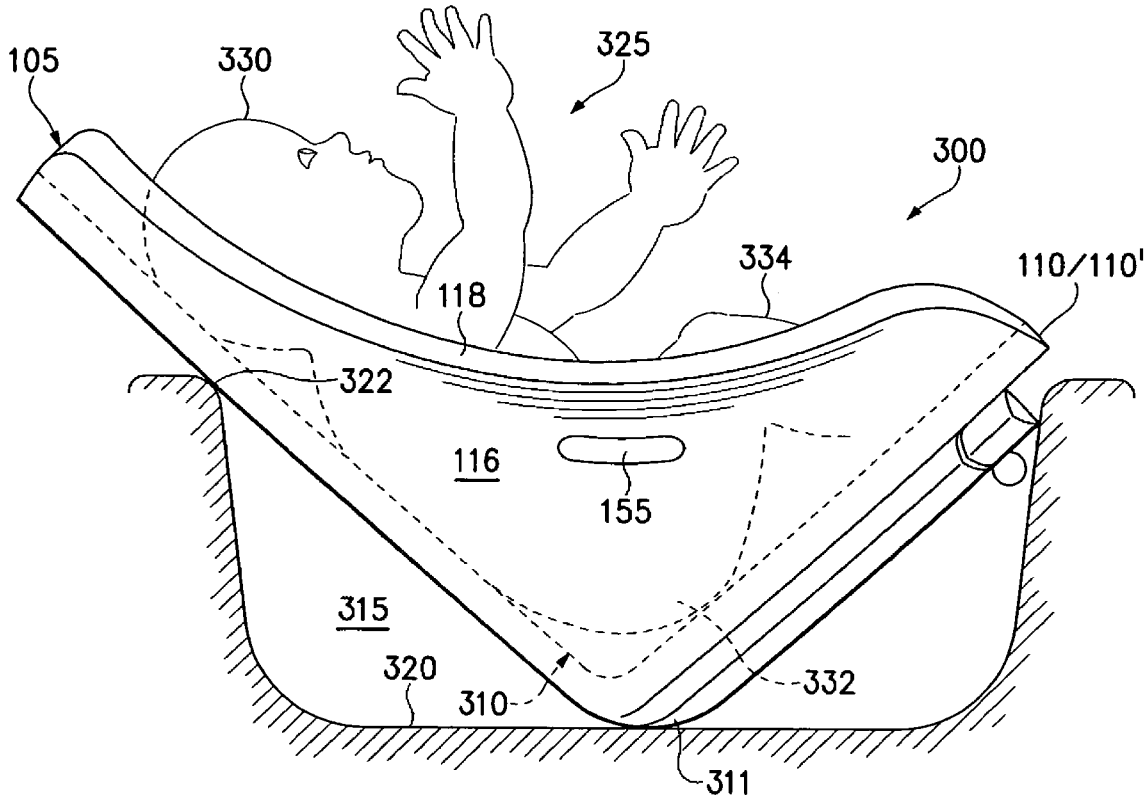
FIG. 3 depicts a side elevation view of a baby bathing apparatus deployed for use, according to an embodiment of the invention.

Turning now to the figures, FIG. 1 depicts an embodiment of the invention in a typical deployed configuration. As shown, the bathing apparatus 100 possesses an appearance similar to an inverted cone with a rounded or truncated vertex. The shape may also be described as concave, bowl-like, substantially parabolic, or deeply-cupped ('concave' herein). The apparatus typically includes an upper body support portion (back portion) 105 extending upward from the 'vertex' of the inverted cone to a greater extent than an opposing lower body retaining portion (front portion) 110/110'. Interposed between and coupling the back portion 105 with the front portion 110/110' are opposing side portions 116/116', herein termed 'right' and 'left' sidewalls respectively for convenience, wherein the right and left sidewall designations correspond to the right and left sides of a baby positioned within the apparatus as shown in FIG. 3.

As shown in the embodiment of FIG. 1, the periphery 118 of one or both of the right and left sidewalls 116/116' may be configured to form an inward curve between an upper end 106 of the back portion 105 and the lower end 111 of the front portion 110/110'. This provides a caregiver with easy access to the baby within the apparatus 100 during bathing by providing a relatively low sidewall over which the caregiver can reach. However, it is also possible in embodiments to configure a relatively higher sidewall on either the left or right side relative to the other side, such as to provide added protection against environmental structure (e.g., a faucet at a rear edge of a sink), or as when a caregiver's preference may be to face the apparatus to one side or the other during use, such as to accommodate the caregiver's left or right handedness. Likewise, both sidewalls 116/116' may be configured relatively higher in an embodiment than that shown in FIG. 1 without departing from the spirit of the invention. Relatively higher sidewalls also provide increased support for each of the front portion 110/110' and back portion 105 in contrast to lower sidewalls, as forces applied outwardly to either or both of the front or back portions will be more evenly distributed by and throughout relatively higher side portions.

Figure 4:
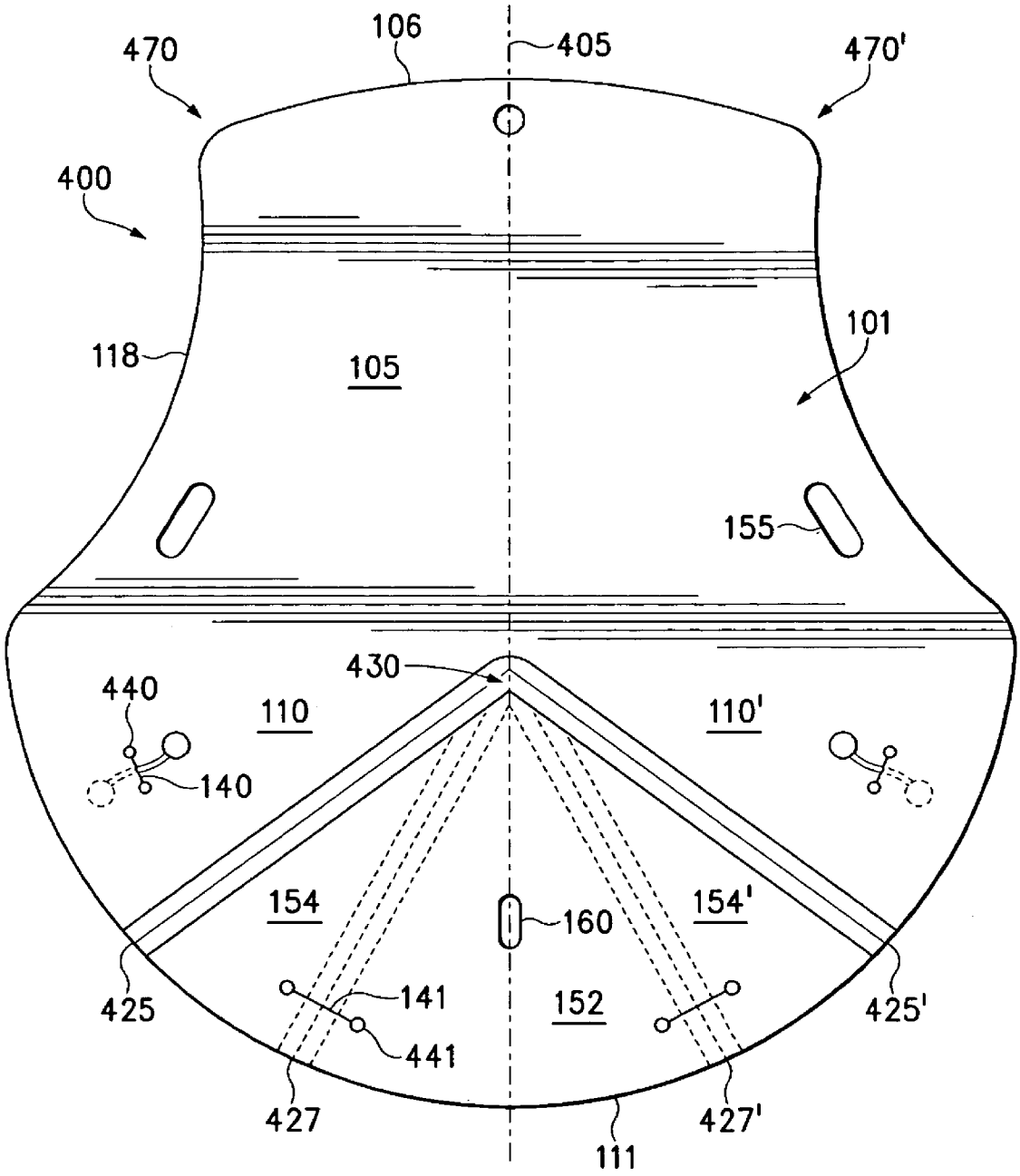
FIG. 4 depicts a plan view of a side of a baby bathing apparatus configured for easy storage, according to an embodiment of the invention.
Figure 5:
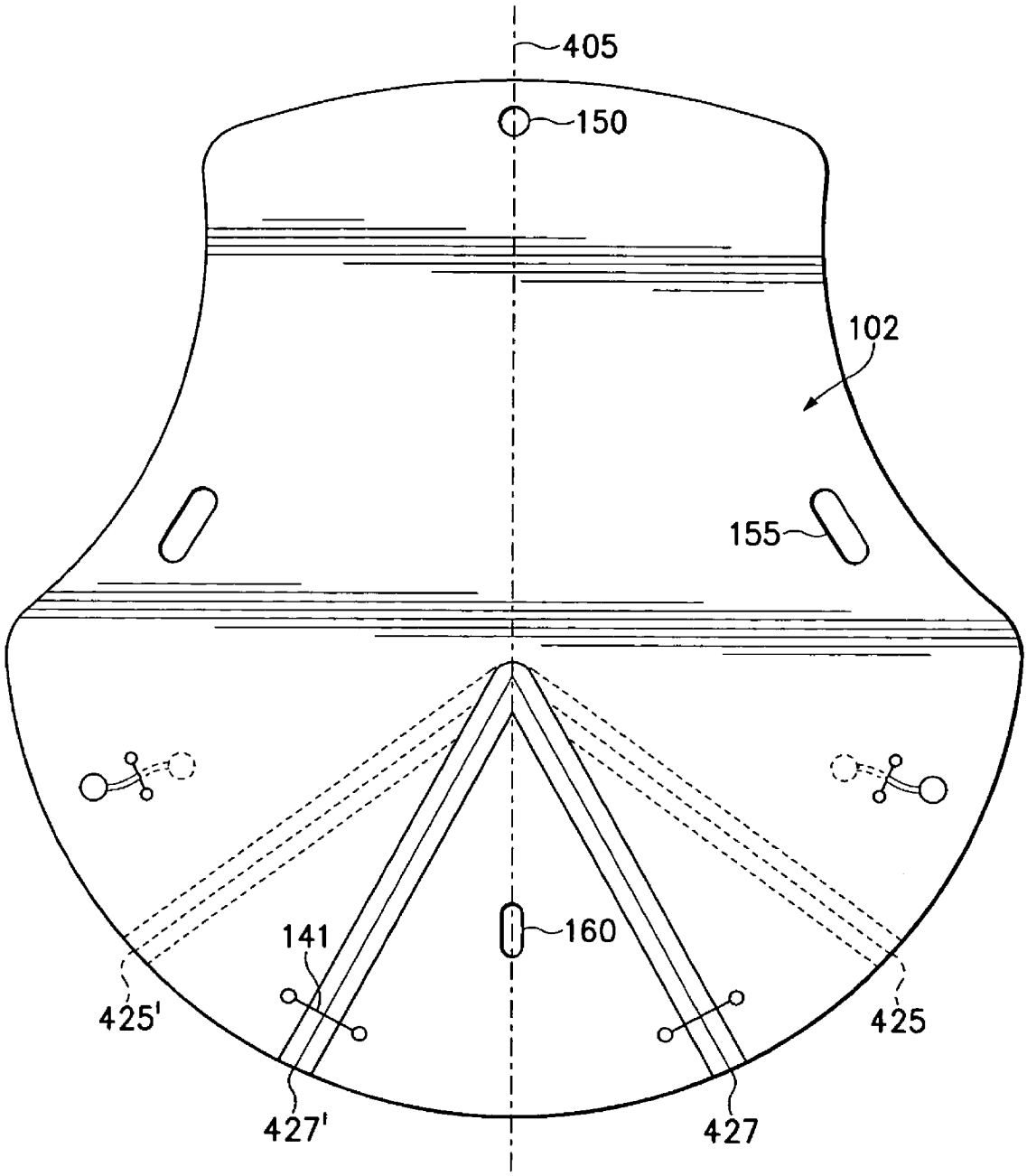
FIG. 5 depicts a plan view of an opposing side of the baby bathing apparatus of FIG. 4, according to an embodiment of the invention.

Each of the front and back portions 110/110'/105 and the right and left sidewalls 116, 116' are formed from a unitary, relatively flat expanse of material 400, as will be further described with regard to FIGS. 4 and 5. The material generally comprises a suitable and relatively uniform thickness of material throughout the expanse, excluding some areas formed with a lesser thickness and/or several perforations formed according to alternative embodiments as later described herein.

The overall thickness may vary in embodiments according to what material is used. For example, in an exemplary embodiment, a relatively uniform thickness falling within the range of approximately 1 to 2 (1-2) centimeters is suitable in an apparatus comprising a closed-cell ethylene-vinyl acetate (EVA) material. EVA provides numerous advantages for the purposes of the described apparatus in numerous embodiments. An expanse of EVA having suitable density, a thickness in the described range, and configured substantially as shown in FIG. 1, possesses sufficient support to hold a baby firmly yet safely, particularly when further augmented structurally by deployment within a rigid basin 315 as substantially depicted in FIG. 3. A baby bathing apparatus 100 comprising EVA presents a soft, pliable inner surface 101 to a baby, avoiding hard, rigid contact surfaces that could injure the baby. The likewise soft, pliable outer surface 102 helps avoid damage to the basin 315 and/or other surfaces. Further, because the outer surface 102 in contact with the basin 315 is pliable and compressible in response to applied force, the outer surface 102 of the apparatus 100 will conform itself somewhat to projecting edges of the basin 315 or other objects, providing firm purchase to help retain the apparatus 100 in position during use.

Closed-cell EVA materials are relatively impervious to water, similar to a closed-cell neoprene or other such materials. Surface properties of an EVA material also provide a relatively slip-resistant surface, even when wetted with water, therefore reducing the likelihood that a baby will shift position (e.g., such as by slipping) within the apparatus 100 during bathing. This characteristic, combined with certain other design attributes of the apparatus 100 described herein, nearly eliminate any chance that a baby might inadvertently slide beneath the surface of and/or inhale any retained bathwater. Of course, in an embodiment, a bathing apparatus can also be formed with a topographically enhanced surface texture at one or more surfaces, adding to the slip-resistant properties of the bathing apparatus, or slip-resistance can be provided by an adhesively and/or mechanically affixed layer, substance, or other material. However applied or provided, inherently or additionally, a bathing apparatus in embodiments will typically possess slip-resistant properties at all or some portion of its surface(s).

In addition, EVA possesses notable thermal insulating properties, helpful both to maintain a more consistent water temperature of water retained within the apparatus during bathing, and to insulate a baby from the substantially warmer or more typically colder surface temperatures of surrounding objects, such as the surface of a basin. In fact, some forms of EVA feel thermally neutral to the touch, neither conveying thermal energy rapidly away from nor toward surfaces with which the EVA comes into contact. An example of EVA displaying the described properties includes EVA Y-E-20 available from Youngbo Chemical Co., Ltd. Therefore, an apparatus formed from EVA provides a comfortable and comforting environment for a baby.

While EVA materials possess a great number of highly beneficial properties, an apparatus according to embodiments described or contemplated herein may likewise be formed from alternative materials possessing properties partially or substantially similar to those demonstrated by EVA. For example, closed-cell neoprene is an effective thermal insulator, provides cushioning, and possesses a relatively slip-resistant surface. Therefore, neoprene could be utilized in an alternative embodiment of the invention if configured with a suitable thickness enabling it to generally retain its shape when configured as shown, for example, in FIG. 1. However, as the density and/or rigidity of different materials may differ, the suitable thickness for any particular material will generally be that thickness or range of thicknesses wherein a bathing apparatus 100 formed from the material will generally retain an operative concave shape when so fastened, and will provide sufficient support to a baby placed therein when positioned within a basin. Therefore, the suitable thickness for an alternate material may fall-outside the range of approximately 1 to 2 (1-2) centimeters described above, and may be found within a broader range of between approximately 0.5 to 5.0 (0.5-5.0 centimeters, yet can also constitute a suitable thickness. In general, a material used in embodiments will typically but not exclusively comprise a relatively pliable, polymeric material.

Whatever material forms an expanse described herein may inherently possess, or be caused to possess, properties which inhibit the growth of various biological and/or pathogenic organisms. For example, various materials possess inherently anti-fungal properties, or may be integrally combined with anti-fungal compounds during forming an expanse, or have such compounds applied after forming an expanse of material. Preferably, embodiments include materials inherently having such properties, however materials having such compounds added either during or after forming is also contemplated in embodiments, provided such materials do not have known detrimental health effects on humans, or specifically on babies. In generally, (although not exclusively so), the materials of an expanse will not provide a suitable medium for the growth and nourishment of harmful organisms. Because a bathing apparatus is used and sometimes stored in a relatively ideal (e.g., wet, warm) environment for growth of harmful organisms (e.g., mold, mildew, fungus, bacteria, etc.), embodiments of the invention help enhance and preserve a baby's good health by inhibiting, or at least failing to support, the growth and proliferation of such organisms.

A material used to form an expanse as described above also can receive and/or retain graphical and/or textual content, applied by whatever means or method is suitable (e.g., adhesive sticker, laminated, painted, molded thermoformed, etc.). Such content can include aesthetically pleasing images, safety information, a maker's mark, use instructions, a thermochromatic temperature indicator, or just about any other type of useful, attractive, informative, or other graphical and/or textual content.

As also shown in FIG. 1, portions of an expanse comprising a bathing apparatus 110 may also be caused to overlap other portions 130 of the expanse when the expanse is deformed into an operative concave configuration. In doing so, a seam and/or gap 135 will typically be formed relatively centrally within the front portion 110 of the bathing apparatus. With reference to FIG. 4, a relatively triangular wedge-like portion of the expanse may be positioned relatively centrally at, and extending inwardly from a periphery of the front portion 110/110' of the expanse. A wedge-like portion can itself include one or more central wedge-like portions (central wedge) 152 and a plurality of smaller peripheral wedge-like portions (left/right wedges, or gussets) 154/154', each delineated from but operatively coupled with the others and/or with the remainder of the expanse, by one or more generally linear thinned portions. For example, each thinned portion can have a thickness which is approximately 10-30% of the relatively uniform thickness of the remainder of the expanse, although thicknesses higher or lower than this range can also be used according to alternative embodiments.

The thinned portions can be formed by removing material from the expanse, by compression forming, and/or by other methods as known in the art. Likewise, a thinned portion can be formed into the expanse as a beveled trough with opposing angular trough 'walls', wherein the thickness of the material progressively thins from the relatively uniform thickness of the expanse down to a minimum trough thickness lying at an intersection between the trough walls. However, not all embodiments include thinned portions. In an alternate embodiment, an expanse formed without thinned portions can be folded and/or otherwise deformed to correspond to the configuration and appearance of the bathing apparatus 100 depicted in FIG. 1. In such embodiments, the wedge-like portion(s) and/or gusseted portions (gussets) can be considered to be integral with the expanse, and become apparent (such as at 130) only when the bathing apparatus is configured for deployment.

FIG. 4 also depicts an exemplary embodiment wherein the expanse includes four thinned portions at, 425, 425', 427 and/or 427'. Two outer thinned portions 425/425' traverse inwardly at substantially corresponding opposing angles from an outer periphery 111 of the front portion 110/110' of the expanse 400, and intersect at a region and/or point (e.g., position) 430 located relatively centrally within the periphery of the expanse. In FIG. 4, this relatively central position 430 is located approximately two-fifths (2/5) of the distance from the periphery 111 of the front portion 110/110' of the expanse 400 to the periphery 106 of the upper portion 105 of the expanse 400, along a conceptual longitudinal line 405 which bisects the expanse 400 into substantially bilaterally symmetrical right and left halves, 470 and 470' respectively. Of course, as previously mentioned, alternative embodiments may not be bilaterally symmetrical about a conceptual central longitudinal line 405, as either a left or right side wall 116/116' may be configured to be higher than an opposing side wall. However, even in such embodiments, a relatively central longitudinal line 405 can nonetheless be envisioned dividing a left half 470 from a right half 470' of the expanse 400.

When the expanse 400 is deformed into a deployed configuration, the relatively central position 430 generally corresponds to the inner vertex (FIG. 3 at 310) of the inverted relatively cone-shaped bathing apparatus 100, also depicted generally as a central seat portion 120 in FIG. 1. Further, portions of the inner surface 101 of the bathing apparatus, such as the transitional area 115 between a sidewall 116 and a front portion 110, will curve inwardly toward the central seating portion 120, as well as curving forwardly from the back portion 105 toward the front portion 110. Such composite curvature of the inner surface 102 of a deployed bathing apparatus 100 contributes to the secure retention of a baby retained therein.

As shown in the embodiment of FIG. 4, the outer thinned portions 425/425' form approximately a ninety (90) degree angle relative to one another (e.g., approx. 45 degrees relative to conceptual longitudinal line 405), although this can vary (e.g., plus or minus approximately 10 degrees) higher or lower in alternative embodiments. Additionally, the relatively planar expanse 400 includes a first relatively planar (inner) surface 101, and a second relatively planar (outer) surface 102, the inner and outer surfaces being substantially planar parallel with one another, and being separated by the relatively uniform thickness of the expanse. Thus, as shown, each of the outer thinned portions 425/425' are both formed into the same relatively planar inner surface 101 of the expanse 400. For the sake of descriptive convenience herein, this surface is referred to as the 'inner' surface because it typically lies within the concavity of the bathing apparatus when the apparatus is configured for deployment within a basin.

Additionally, as shown by phantom lines in FIG. 4 and more clearly shown in FIG. 5, a plurality of additional 'inner' thinned portions 427/427' (in this embodiment, two thinned portions), are similarly formed into the expanse. In this instance, 'inner' refers to the position of thinned portions 427/427' relative to the 'outer' thinned portions 425/425', not because of a positional relationship relative to the inner surface 101 of the expanse. The inner thinned portions 427/427' lie positionally between the outer thinned portions 425/425', but are formed into the outer surface 102 of the expanse 400 rather than the inner surface 101. Each relatively linear inner thinned portion 427/427' likewise proceeds from the periphery 111 of the front portion 110/110' of the expanse 400 and terminates at the relatively common region 430 with each of the outer thinned portions 425/425' and with each other thinned portion. The inner thinned portions 427/427' each bisect corresponding left and right halves of the wedge-like portion, wherein the right and left halves lie on corresponding right and left sides, respectively, of the longitudinal line 405 through the expanse 400. Therefore, as shown in the embodiment of FIG. 4, the wedge-like portion is divided into a central wedge-like portion (central wedge) 152 comprising approximately one-half (½) of the overall wedge-like portion, and the opposing right 154 and left 154' wedge-like portions (left and right wedges) bound the central wedge 152, one each side, and each comprise approximately one-quarter of the area of the overall wedge-like portion of the expanse 400.

If, for example, a relatively common termination region 430 for the thinned portions which is configured relatively close to the front portion 110/110', an angle of each outer thinned portion 425/425' relative to a longitudinal center line 405 and/or to an opposing outer thinned portion can be substantially higher that the ranges mentioned above. For example, an angle of an outer thinned portion 425/425' relative to a longitudinal center line 405 can be approximately ninety (90) degrees in an embodiment. Conversely, such angles can be as low as approximately twenty (20) degrees in other embodiments when the common termination region 430 is configured relatively farther from a periphery 111 of the front portion 110/110'.

Each thinned portion functions as a live 'hinge', allowing each wedge coupled with the hinge to flex substantially relative to adjacent portions of the expanse and/or the adjacent wedges. Therefore, as shown in FIG. 1 and in greater detail in FIG. 7, the opposing front portions 110/110' of the expanse adjacent to and extending outwardly from each of the outer thinned portions 425/425' can be drawn together toward the central longitudinal line 405, causing the expanse 400 to deform into a substantially concave shape. In doing so, each of the outer thinned portions 425/425' flex until the outer surfaces 102 of the right and left wedges 154/154' arrive into close proximity to (or into contact with) the outer surfaces 102 of the proximate and corresponding right and left front portions 110/110', respectively, of the expanse 400. At the same time, each of the inner thinned portions 427/427' flex until the inner surfaces 101 of each of the left and right wedges 154/154' arrive into close proximity to (or into contact with) the inner surface 101 of the central wedge 152.

Therefore, as described above and substantially shown in FIGS. 1 and 7, the increased thickness at the front portions 110/110' of the apparatus created by these overlapping thicknesses of material adds to the overall structural rigidity of the deployed bathing apparatus 100, providing additional support to securely receive and support a baby for bathing. However, to help retain the bathing apparatus 100 in the deployed, relative concave configuration, fastening means are employed in an embodiment of the invention.

Figure 2:
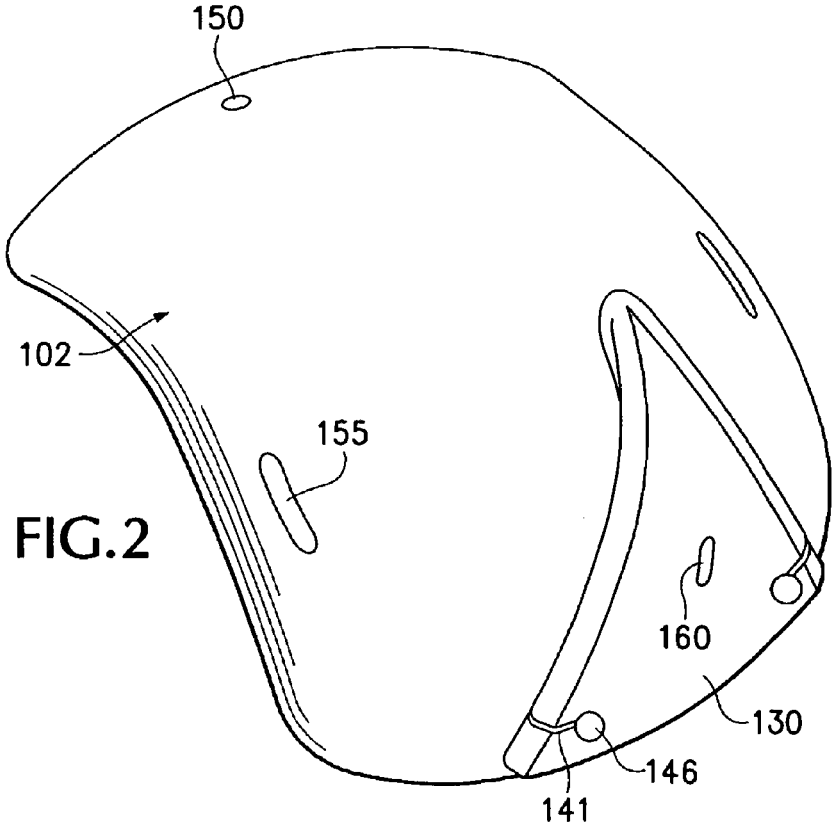
FIG. 2 depicts another isometric view of to the baby bathing apparatus of FIG. 1, according to an embodiment of the invention.

FIGS. 1 and 2 each depict a portion of one or more fastening means (fasteners) retaining a bathing apparatus 100 in a generally deployed configuration according to an embodiment of the invention. FIG. 1 shows a perforation 140 through the material of the expanse near the periphery 111 of the bottom portion 110/110', and an enlarged portion 145 of a fastener retained proximate the inner surface 101 of the expanse corresponding to the perforation 140. FIG. 2 depicts a substantially similar enlarged portion of a fastener 146 retained proximate the outer surface 102 of the expanse held in a likewise deployed configuration. As further and more clearly illustrated in the cross-sectional view of FIG. 7 through the overlapping right/left 154/154' and central 152 wedges and the lower portion 110/110' of the expanse, the enlarged fastener portions 145/146 depicted in FIGS. 1 and 2 comprise a contiguous fastener 745 extending fully through the overlapping wedges and the lower portion of the expanse. A relatively linear central portion 747 of the fastener 745 has a smaller cross-sectional dimension (e.g., diameter) than does either of the enlarged ends 145/146. It is generally the central portion 747 of each fastener 745 which extends through the overlapping thicknesses of material, while the opposing enlarged portions (e.g, lobes, etc.) 145/146 are retained at the respective inner and outer surfaces 101/102 of the front portion 110/110' of the expanse and the central wedge 152.

To allow one or more fasteners 745 to extend through the material at a front portion 110/110' of the expanse, one or more perforations 140 are generally formed through a front portion 110/110' of the expanse and located as shown in FIGS. 1, 4, and 5, for example. Each such perforation 140 may be generally linear as shown, or may take other forms, but are typically formed through the entire thickness of the expanse forming a passage from the inner surface 101 to the outer surface 102. The length of a linear perforation 140 will generally be marginally greater than the diameter of a corresponding enlarged end 145/146 of a fastener 745 intended to be passed through the perforation. However, in embodiments, the perforations 140 can be significantly longer than the diameter of a fastener end 145/146.

Although formed fully through the expanse, each perforation 140 thusly formed generally retains a substantially and compressively closed condition due to the pliable nature of the material of the expanse, therefore helping to retain a portion of a fastener extending therethrough. At one or more ends of each linear perforation 140, the perforation may be enlarged and/or rounded as at 440 to help deter incidental tearing of the perforation due to applied stresses, wear, or other influences.

As also shown in FIGS. 4 and 5, one or more perforations 141 are also generally formed through the wedge-like portion, somewhat inset from the periphery 111 of the front portion 110/110', and on either one of or both sides of the longitudinal line 405. When the bathing apparatus 100 is configured for deployment, the positions of each such perforation 141 generally corresponds to a perforation 140 formed through the lower portion of the expanse as previously described. The one or more perforations 141 may be generally linear as shown, or may take other forms, but are typically formed through the entire thickness of the expanse forming a passage from the inner surface 101 to the outer surface 102. As configured, the purpose of the one or more perforations 141 is to receive and retain a fastener 745 configured to retain the bathing apparatus 100 in a deployed configuration. Although formed fully through the expanse, each perforation 141 thusly formed generally retains a substantially closed condition due to the elastic nature of the material of the expanse, therefore helping to retain a portion of a fastener 745 inserted therethrough. At one or more ends of each linear perforation 141, the perforation may be enlarged and/or rounded as at 441 to help deter incidental tearing of the perforation 141 due to applied stresses, wear, or other influences.

As shown in FIGS. 4 and 5, the one or more perforations 141 can be positioned and formed to traverse one or more of the inner thinned portions 427/427' in a generally perpendicular orientation with respect to the thinned portion(s) 427/427'. So positioned, the ends of each generally linear perforation 141 terminate at opposite sides of a thinned portion(s) 427/427' from each other. Therefore, when a thinned portion 427/427' (hinge) traversed by a perforation 141 is flexed, as when the bathing apparatus 101 assumes a deployed configuration, the perforation 141 forms an opening traversing inward from an edge of the overlapping left and/or right wedge 154/154' and the central wedge 152, as shown in FIG. 2.

In general, a bathing apparatus 100, can be stored as a relatively planar expanse 400 when not being used for bathing. However, the features described and depicted enable the expanse to be rapidly and easily configured for deployment. During storage, the one or more fasteners 745 can remain extended through perforations 140 for convenience. When the opposing right and left front portions 110/110' are drawn together and the thinned portions are flexed as depicted in FIGS. 1 and 2, an enlarged portion 146 of a fastener 745 can be grasped by the user and pulled so that the central portion 747 of the fastener 745 is guided into a corresponding perforation 141 formed through a fully flexed inner thinned portion 427/427'. Because the perforation 141 traverses the thinned portion 427/427' relatively perpendicularly, the perforation presents to the user as an open seam at the edge of the flexed inner thinned portion 427/427' through the thicknesses of both the central wedge 152 and a corresponding right or left wedge 154/154', respectively. Therefore, as shown in FIG. 7, when the user places the central portion 747 of a fastener 745 into the perforation 141, the thicknesses of the material of the central wedge 152, a corresponding right or left wedge 154/154', and a corresponding right or left half of the front portion 110/110' of the expanse are retained securely between the opposing enlarged ends 145/146 of the fastener 745, with the central portion 747 of the fastener 745 extending through the perforations 140/141 in the respective thicknesses of material.

Figure 7:
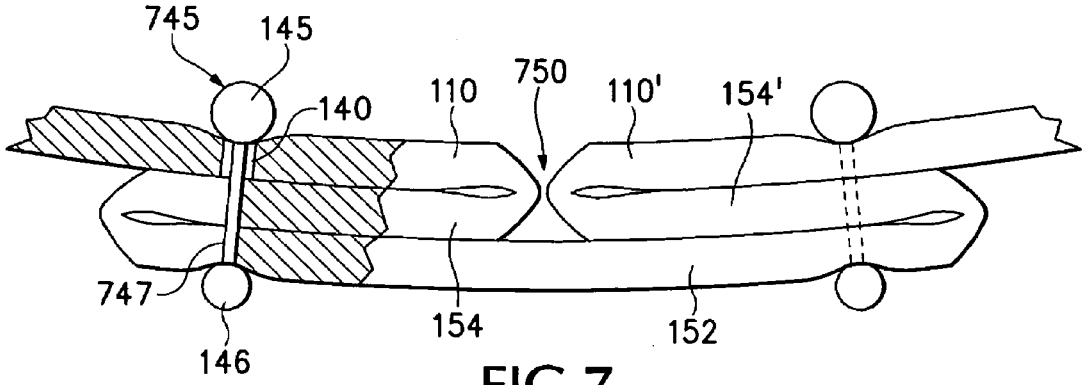
FIG. 7 depicts a cross-sectional view of a portion of a baby bathing apparatus deployed for use, and showing fastening devices and arrangements according to alternative embodiments of the invention.

In general, a fastener 745 configured and employed substantially as depicted in FIGS. 1, 2 and 7 comprises one or more relatively elastic materials, enabling the fastener to elongate and contract along a longitudinal axis extending through each of the enlarged end portions 145/146 and the central portion 747. A length of the central portion 747 of a fastener 745 will generally be the marginally shorter than the collective thicknesses of the overlapping materials through which the fastener 745 extends when the bathing apparatus is configured for deployment. Therefore, the fastener remains relatively elastically elongated while in a deployed condition, and the opposing enlarged ends 145/146 apply a compressive force upon the respective inner and outer surfaces 101/102, helping to retain the bathing apparatus in the deployed configuration.

As also shown in FIGS. 2, 4 and 5, one or more perforations 160 are also formed through the thickness of the expanse 400 according to an embodiment, providing an opening through which water accumulating within the bathing apparatus 100 can drain out during use. The position of such opening 160, can be configured to limit the depth of water retained by the bathing apparatus 100, such as by forming such opening 160 close to the inner 'vertex' (FIG. 3 at 310) to allow little or no water to accumulate, or by forming such opening further from the inner vertex 310, and closer to a periphery 106/111/118 of the expanse 400, allowing substantially more water to accumulate in the bathing apparatus 100 during use. In an alternative embodiments, there may be provided either no such openings allowing drainage, and rather the configuration of the periphery of the bathing apparatus (e.g., low side walls 116/116') regulates water depth, or there may be provided a plurality of such openings, wherein one or more of the plurality of openings may be plugged and/or unplugged by a user to regulate water accumulation within the bathing apparatus 100.

As shown in the embodiment of FIGS. 4 and 5, an opening can be formed in the central wedge 152, such as along a relatively central longitudinal line 405, approximately halfway between the periphery 111 of the front portion 110/110' of the expanse 400 and the common convergence position 430 of the various thinned portions 425/425'/427/427'. An opening 160 so positioned aligns in a deployed bathing apparatus 100 with a seam and/or gap 750 formed between the adjacent outer thinned portions 425/425', allowing water to access the opening 160 through the gap 750. At the same time, the close proximity of the adjacent outer thinned portions 425/425' and the position of the opening 160 therebehind helps prevent the risk of a baby extending a hand, foot, or other appendage through the opening 160 and possibly being pinched between the bathing apparatus 100 and a surface of a basin 315. Of course, an opening 160 can likewise be formed in other portions of the expanse in alternative embodiments without departing from the spirit of the invention.

In an embodiment depicted in FIGS. 1, 2, 4 and 5, a perforation 150 is also formed through the material of the expanse near the periphery 106 of the back portion 105. A perforation 150 so formed may be used, for example, to suspend the relatively planar expanse from a cantilevered projection (e.g., a hook, peg, or similar structure) when not in use, by inserting such projection therethrough. Alternatively, a perforation 150 can likewise be formed proximate to the periphery at another portion of the expanse, or a plurality of openings 150 can be formed rather than only a single opening 150. The size of the opening(s) 150 can vary, and the opening (s) 150 can generally remain open as depicted in the listed figures or can generally remain compressively closed similarly to perforations 140/141, according to alternative embodiments.

As also depicted in FIGS. 1, 2, 4 and 5, and additionally in FIG. 3, one or more additional perforations 155 can be formed into and through the right and/or left sidewalls 116/116'. Such perforations 155 can comprise relatively elongate openings as depicted in the figures, but may instead comprise alternative configurations. The openings are generally formed fully through a thickness of the expanse 400 relatively proximate to a periphery 118 of the expanse, and enable a user to conveniently grasp the expanse for carrying, or to reposition the bathing apparatus 100 (e.g., within a basin) when configured for deployment. Such openings 155 may take the place of and function similarly to the opening 160 by allowing water to drain from the bathing apparatus 100, or may be placed closer to a periphery than opening 160 or otherwise positioned so that water drains primarily from opening 160. In embodiments, an opening 155 in a sidewall 116/116' can be configured to allow insertion of a faucet through the sidewall, allowing dispensing of water directly from the faucet into the bathing apparatus 100.

As with perforations 150 and/or 160, the size, shape, quantity and location(s) of perforations 155 within the expanse can vary in alternative embodiments, providing various benefits to a user during use for bathing a baby, or while transporting or storing the bathing apparatus 100, and in either its deployed and/or generally planar configurations.

Figure 6:
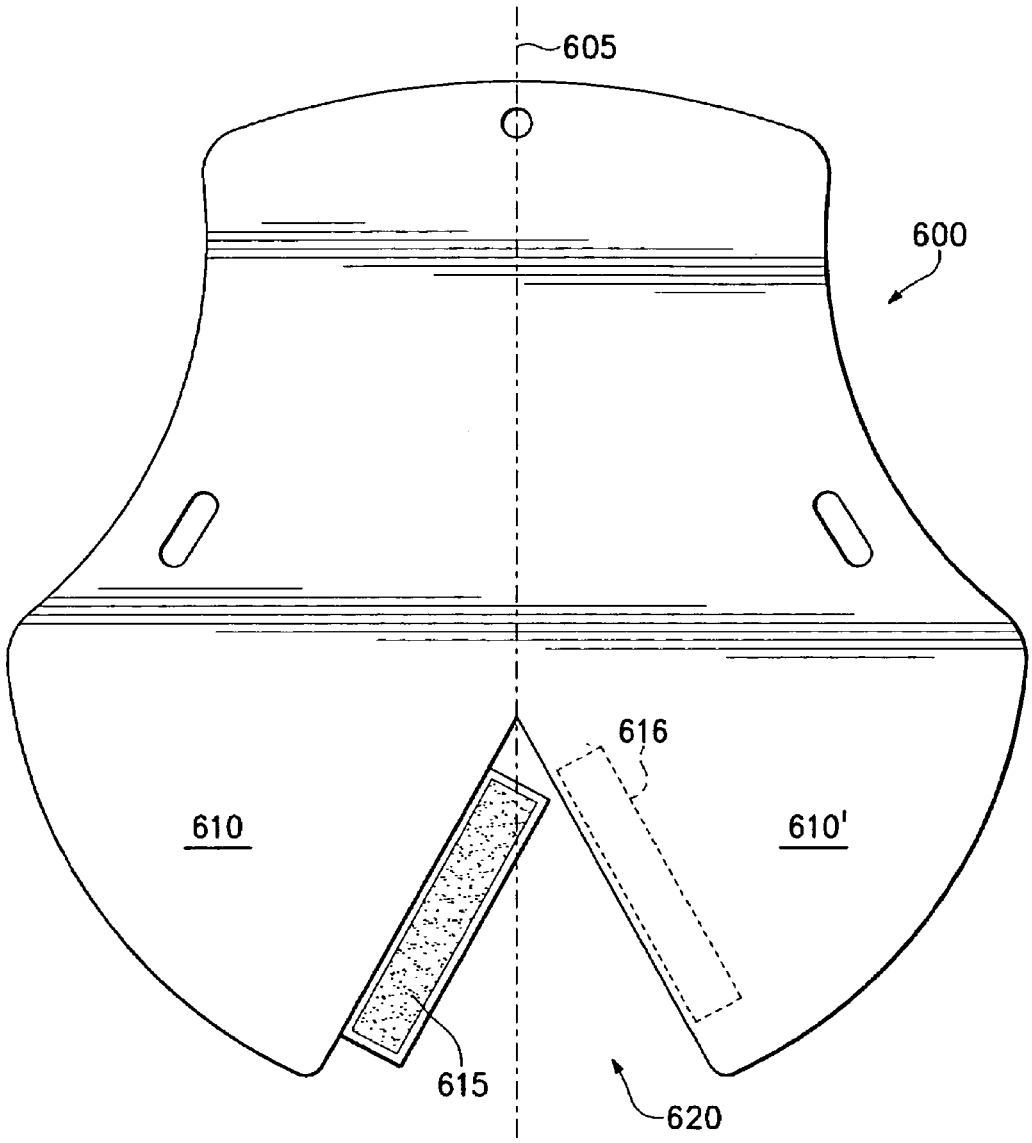
FIG. 6 depicts a plan view of a side of a baby bathing apparatus configured for easy storage, according to an alternative embodiment of the invention.

With reference to FIG. 6, an embodiment may include an alternative and relatively integrated attachment means which does not require perforations formed through the material. For example, a fastening means can include an arrangement comprising reciprocal structures 615/616 operatively coupled with opposing front portions 610/610' proximate opposing sides of the wedge-like portion 620. One such structure 615 may comprise either or both of exposed hook and/or loop elements, while the reciprocal structure 616 includes complementary and correspondingly positioned elements configured to securely and detachably engage with the hook and/or loop elements of structure 615. One of either structure 615 or 616 extends outward from a front portion, 610 or 610', and projects inwardly toward the wedge-like portion 620, while the other of structure 615 or 616 may either extend inwardly toward the wedge-like portion 620, or as shown in FIG. 6, lie coupled with and substantially or fully overlapping the front portion 610 and/or 610' and lying outside the wedge-like portion 620. Therefore, when the opposing sides of wedge-like portion 620 are drawn together to deform the expanse 600 into a relatively concave deployed configuration can be caused to overlie structure 616, enabling the reciprocal hook and loop elements of structures 615 and 616 to securely yet detachably engage and retain the bathing apparatus in a deployed configuration.

Likewise, one having ordinary skill in the art will understand from the figures and descriptions provided herein that multiple structures 615/616 may be employed in a fastening arrangement rather than just one of each. Further, rather than the hook and loop fastening means depicted in FIG. 6, alternative fastening means may also be used to securely yet detachably retain a bathing apparatus in a deployed configuration without departing from the spirit of the invention. Such alternative fastening means can include, individually or in any combination, relatively rigid hooks and/or catches, removable adhesive strips, buttons, strands, pegs, clips, clamps, magnets embedded within the material of the expanse, reciprocal suction cups or a suction cup and a reciprocal flat surface sufficiently configured to receive and maintain a suction attachment by the suction cup, or nearly any other fastening means as known in the art.

Fastening means may be relatively permanently integrated with the expanse either mechanically, adhesively, or otherwise, or may be relatively separable from the expanse, or may be obtained wholly independently (e.g., a roll of tape, etc.) and used in association with structures, surfaces, perforations, or other features of a bathing apparatus to securely yet detachably retain the bathing apparatus in a deployed configuration. The fastening means employed may be coupled with an inner surface 101 of the expanse, with an outer surface 102, with the material of the expanse intermediate the inner and outer surfaces, or any combination thereof. Therefore, the fastening means specifically listed and/or depicted herein are for illustrative purposes only, and do not in any way limit the scope of fastening means available or conceived for use according to alternative embodiments of the invention.

Indeed, an embodiment of the invention is contemplated wherein once configured for deployment, the weight of a baby placed within the bathing apparatus itself, and/or the inner configuration of a basin within which the bathing apparatus is placed, is sufficient to retain the bathing apparatus in the deployed configuration, even within the need for a fastening apparatus, or with the aid of a minimally robust fastening apparatus.

Likewise, the wedge-like portion 620 can vary greatly in configuration, material, and other aspects in alternative embodiments. As shown in FIG. 6, the wedge-like portion 620 can comprise a relatively triangular absence of the material comprising most of the remainder of the expanse 600. When deformed into a deployed configuration, the front portions 610/610' of the expanse 600 generally converge at a position corresponding to a longitudinal line 605, and substantially close the open space previously comprising the wedge-like portion 620. As one having ordinary skill will understand, because the wedge-like portion 620 in an embodiment substantially similar to that of FIG. 6 may comprise an absence of material, it generally is also characterized by an absence of such features as the thinned portions 425/425'/427/427', the central 152, right 154, and left 154' wedges, perforations 141 and/or 160, and other such structures comprising and/or formed into the material of a wedge-like portion depicted in FIGS. 4 and 5, among others. Likewise, other structures and/or features found alternative embodiments, such as perforations 140 or those otherwise cooperatively functioning in association with the material of a wedge-like portion, may be neither necessary nor present in an embodiment substantially similar to that of FIG. 6. Rather, the water-draining function of, for example perforation 160, can be fulfilled by an opening remaining in the deployed bathing apparatus of FIG. 6 where the wedge-like portion 620 existed prior to configuring the expanse for deployment.

Alternatively, the wedge-like portion 620 of FIG. 6 may comprise an absence of the material comprising the remainder of the expanse 600, but may also comprise a fabric, membrane, film, sheet, mesh, webbing, or other similar material (collectively for convenience herein, 'webbing') coupled with the expanse 600 and configured to partially or fully extend across the otherwise open wedge-like portion 620 of the expanse 600. The webbing may include perforations integrally comprising or otherwise formed into the material of the webbing, allowing for water drainage from the bathing apparatus, but such provision is not necessary in all embodiments. The webbing will generally be flexible allowing the user to easily draw together and secure the corresponding front portions 610/610' of the expanse for deployment, and will further be configured either to enable the employed fastening means, or alternatively to not obstruct or interfere with the fastening means. Additionally, in an embodiment, the webbing may include one or more elements of an employed fastening means (e.g., wherein at least one element of a fastening means is, for example, integrally and/or detachably coupled with the webbing), and therefore may participate in securing the expanse in a deployed configuration. When not deployed for use, the webbing will typically allow the expanse to recover a relatively planar configuration.

In yet another embodiment, an expanse (e.g., sheet) comprising a bathing apparatus may itself comprise a plurality of laterally juxtaposed individual elongate segments sequentially and flexibly coupled one to another. Each segment may be coupled with one or more adjacent segments by a hinge-like structure or arrangement allowing each segment to articulate relative to one or more of the adjacent segments. The plurality of elongate segments may be arranged so as to radiate outward from a relatively central region of the sheet, and by folding portions of the sheet (e.g., one or more segments) so as to overlie other portions, a relatively planar expanse can assume a relatively concave configuration with an inner vertex located approximately at the relatively central region of the sheet.

Elongate segments may comprise natural materials such as bamboo, bundled grasses, or other materials constituting renewable resources, or alternatively can comprise man-made materials (e.g., configured as compressed fibers, rods, slats, etc.). In such embodiments, a bathing apparatus may be relatively rigid from the central region of the expanse outward toward the periphery, resisting collapse of a deployed bathing apparatus upon application of a load such as a baby placed within the apparatus. However, at the same time, due to the inherent flexibility and articulability of the segments relative to one another, the bathing apparatus may be folded numerous times sequentially (e.g., in half, then quarters, then eighths) producing a very compact-sized unit for storage.

Because the individual segments and/or groups of segments may be flexed and/or folded relative to adjacent segments, and caused to overlie adjacent segments, segments of the sheet can function as the gussets and/or the wedge-like portions present in earlier described embodiments. Therefore, these features can be considered integrally included within the sheet although they may not exist as separate and/or structurally differently configured elements. That is, the configuration of an embodiment of a bathing apparatus so configured may appear bilaterally symmetrical relative to any line passing through the center of and bisecting the sheet, yet portions of the sheet may be considered and function as gussets and/or wedge-like portions to configure the sheet into a deployed bathing apparatus.

In another embodiment, an expanse includes a plurality of elongate segments, each aligned relatively in parallel with each adjacent elongate segment. The segments may either be curved, each approximately equally with the others, or may be relatively linear but flexible, such that the segments can assume a curved condition in response to a load placed thereupon. The plurality of segments each have first and second opposing ends. The first ends of the plurality of segments are pivotably coupled together, and the second ends of the plurality of segments are likewise pivotably coupled together, forming a bundle of segments relatively aligned along their long axes. Therefore, a relatively central portion intermediate the first and second ends of each segment can be caused to separate and spread outwardly from adjacent segments, pivoting about the pivotable couplings at each of the first and second ends.

Each segment in the bundle of segments may likewise be operatively coupled with a flexible layer and/or sheet of material (e.g., fabric, mesh, membrane, etc.), wherein each segment, when pivoted at a relatively central portion away from each adjacent segment, can only separate from adjacent segments by a limited distance corresponding to the relative attachment positions of each segment or segment portion with the flexible layer/sheet. Thus, the layer/sheet forms a web, configured either to retain water or to allow water to pass through and drain away, which extends between each segment and each adjacent segment and limits a maximum amount of separation attainable between one segment and each adjacent segment.

Alternatively, rather than a layer/sheet, adjacent segments may be coupled with and by a filamentous and/or other flexible and relatively linear member (e.g., string, rope, cable, tube, strap, etc.). In either case, a baby bathing apparatus so constructed can be expanded to a form hammock-like or canoe-like configuration, but possessing a degree of flexible rigidity along a long axis due to the collective rigidity of the segments.

A baby bathing apparatus so configured likewise forms a relatively concave deployed configuration, particularly when supporting a baby, yet can assume a relatively compact and easily stored configuration when the plurality of segments are pivoted together as a bundle.

As previously presented, the configuration of a periphery of a bathing apparatus, when configured as a relatively planar expanse of material, is quite variable. Typically, the peripheral shape of an expanse may be relatively spade-like as in FIGS. 4 and 5, with a relatively broadened front portion 110/110', and a somewhat narrower back portion 105. This shape perhaps more closely resembles that of a scallop shell, in particular the shell of the Great Scallop (i.e., Pecten maximus), wherein one end of the shape is relatively narrow, and the opposing end is relatively wider as compared to the narrow end. Alternatively, the peripheral shape can vary from circular, to ovoid, to irregular, with the extreme periphery being either smooth or comprising inward and outward deviations of variable size, shape, and number. In generally, the embodiments of the invention encompass nearly any operable peripheral configuration structurally and functionally compatible with use as a bathing apparatus, and capable of alternating between a relatively concave deployed configuration and a relatively planar non-deployed configuration.

As depicted in the exemplary embodiment of FIG. 3, a bathing apparatus 300 configured for deployment may be placed into and retained within a basin 315 (e.g., bathroom or kitchen sink, a small to moderately-sized tub, etc.). In general, the outer vertex 311 of the relatively (inverted) cone-like bathing apparatus 300 will rest upon a relatively stable surface or platform 320 within the basin 315. The back portion 105 of the bathing apparatus 300 will rest against a rim portion 322 or another portion of the basin 320. As mentioned, a relatively rigid rim portion 322 will tend to compress the material of the back portion 105 to some extent, helping to retain the bathing apparatus 300 in position.

Also typically, a front portion 110/110' of the bathing apparatus 300, or another portion of the bathing apparatus 300 proximate the front portion 110/110', will contact a rim portion 322 or another portion of the basin 315 opposite that of the back portion 105. Similarly, the front portion 110/110' of the bathing apparatus 300 in contact with the rim 322 will also tend to be compressed thereby, helping to retain the bathing apparatus 300 in a relatively stable position within the basin 315. Depending upon the size and configuration of the basin 315, the size and configuration of the bathing apparatus 300, and the position of the bathing apparatus 300 within the basin 315, one or more of the side walls 116/116' may likewise contact a rim portion 322 or another portion of the basin 315. As can be expected, the combined weight of a baby 325 and/or any water retained within the bathing apparatus 300 will further cause relatively rigid surfaces of the basin 315 to compress the contacted material of the bathing apparatus 300, further securing and retaining the bathing apparatus in place within the basin 315.

A baby 325 will generally be placed within the bathing apparatus as shown in FIG. 3, so that the back portion 105 of the bathing apparatus 300 supports and retains the head 330 and upper body of the baby 325, the front portion 110/110' of the bathing apparatus 300 supports and retains the legs 334 and feet of the baby 325, and the baby's buttocks 332 rest within and/or are retained proximate to the inner vertex 310 of the bathing apparatus. Because the baby's head/upper body 330 and legs/feet 334 are both elevated relative to the baby's buttocks 332, the baby 325 is held relatively firmly in position within the bathing apparatus 300. Likewise, because the bathing apparatus 300 typically comprises a material characterized by a relatively slip-resistant surface and compressibility in response to applied force, the baby's movements during bathing will tend not to cause the baby 325 to slip about within the bathing apparatus 300, thereby substantially reducing the chance that a baby's head will slip beneath the surface of any water present within the bathing apparatus 300 or otherwise substantially shift position therein.

As previously described, fastening means for securing and retaining a bathing apparatus in a deployed configuration can comprise a relatively elongate fastener with relatively enlarged ends and a central portion with a cross-sectional dimension that is smaller than that of either of the ends. FIGS. 8 and 9 present numerous embodiments of fasteners so configured, and additional features and elements thereof.

As shown in FIGS. 8*a-d*, the enlarged ends of a fastener may take any of numerous forms according to alternative embodiments of the invention. As shown with regard to the exemplary embodiment of FIG. 8*b*, a fastening means 800 includes a first end 845 configured for retention proximate to an inner surface of a bathing apparatus as shown at 145 in FIG. 1, and therefore is referred to hereinafter (for convenience only, and not in an otherwise limiting sense) as an 'inner end' 845. Each of FIGS. 8*a*-8*d* depict structurally distinct yet functionally similar inner ends 845. Each possesses a cross-sectional dimension in at least one axis (e.g., perpendicular to a longitudinal axis passing through both ends and the central portion) which is greater than that of a relatively elongate central portion 847, and configured to resist being easily withdrawn from a perforation (e.g., such as 140 in FIG. 1) through the material of a bathing apparatus once inserted therethrough.

In general, a fastener inner end 845 will also be configured without features that could poke, scratch, or snag, or otherwise potentially injure a baby 325 or a user of a bathing apparatus 300. This may include providing a relatively flattened inner end 845 as in FIG. 8*c*, or a relatively smoothly rounded inner end 845 as in FIG. 8*b*. However, an inner end 845 can also be ornamental, such as those shown in FIGS. 8*a* and 8*c*.

A fastener retention flange 801 is also present in an embodiment, to retain a fastener 800 in position extended through a perforation during use. For example, the inner end 845 of the fastener 800 is retained proximate to, and typically in contact with, an inner surface 101 of an expanse 400, and the retention flange 801 is retained proximate to, and typically in contact with, an outer surface 102 of the expanse 400. Thus, the fastener 800 is held in position such that the thickness of the expanse 400 of material is retained between the inner end 845 and the retention flange 801.

Figure 8A:
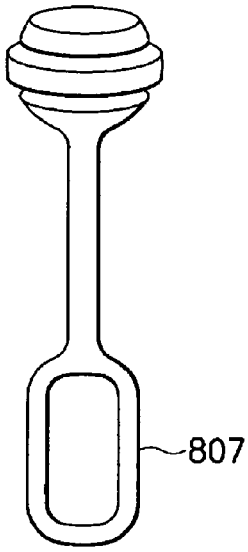
FIGS. 8*a*-8*d* depict elongate fasteners according to alternative embodiments of the invention.
Figure 8B:
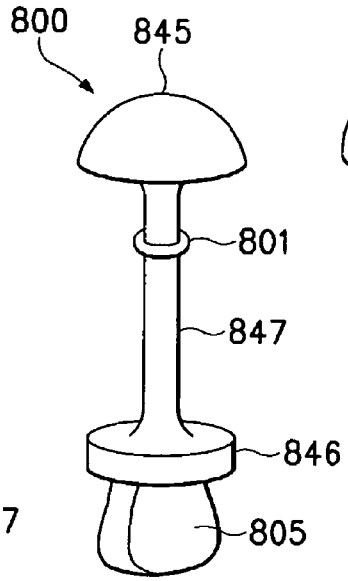

Turning again to the illustrative example of FIG. 8*b*, a fastener also includes a second end 846 configured for retention proximate to an outer surface of a bathing apparatus as shown at 146 in FIG. 2, and therefore is referred to hereinafter (for convenience only, and not in an otherwise limiting sense) as an 'outer end' 846. The conceived forms for configuring an outer end 846 are likewise highly variable as depicted in FIGS. 8*a-d* and 9*a-d*. In each case, however, a cross-sectional dimension of the outer end 846 in at least one axis perpendicular to a longitudinal axis of the fastener 800 will exceed a cross-sectional dimension of the central portion 847 of the fastener.

In general, an outer end 846 is configured to serve two primary purposes. The first is to securely yet detachably retain a bathing apparatus in a deployed configuration, typically be retaining a plurality of thicknesses of material of the bathing apparatus in close proximity to one another. To achieve this purpose, the outer end 846 is configured to resist being pulled into and/or though a perforation 141 in a bathing apparatus 300 due to either elastic contraction forces applied by the fastener 800 itself, or due to forces applied during normal handling or use of a bathing apparatus 300.

Figure 8C:
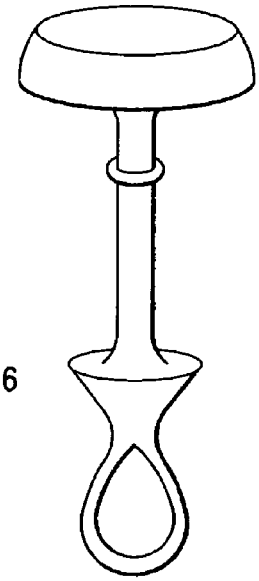
Figure 8D:
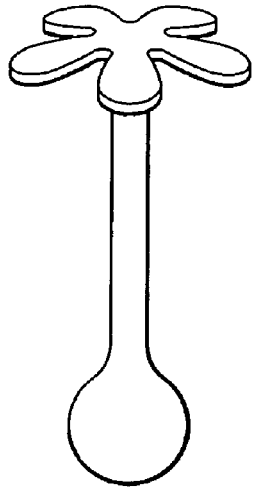

As shown in FIGS. 8*b* and 8C, as well as FIGS. 9*a-d*, an outer end may include a cross-sectionally relatively large and substantially flattened portion configured to contact an outer surface 102 of a bathing apparatus 300. This flattened surface provides firm resistance against inadvertent or unintended 'pull-through' of the fastener outer end 846 through a perforation 141 during use. Alternatively, an outer end may be relatively rounded, as shown in FIG. 8*d*, or may comprise either a filled or open loop, as shown at 807 in FIG. 8*a*, or comprise an easily grippable tab, as shown at 805 in FIG. 8*b*. In yet other embodiments, an outer end 846 may comprise any combination of flattened portions, rounded portions, tabs, loops, and/or other features as also shown in FIGS. 8*b* and 8*c*, or otherwise meeting one or more of the stated functions and/or purposes.

Figure 9A:
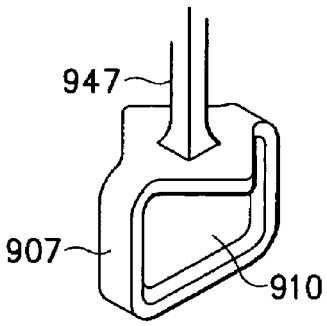
FIGS. 9*a-d* depict portions of an elongate fastener according to alternative embodiments of the invention.
Figure 9B:
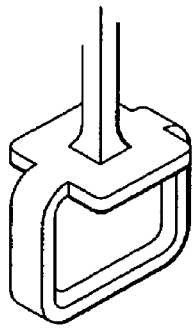
Figure 9C:
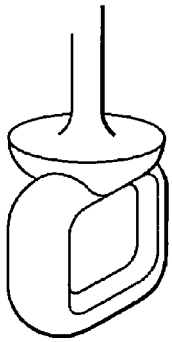
Figure 9D:
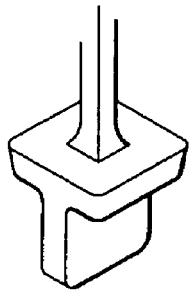

As shown in FIG. 9*a*, the cross-sectional shape of a relatively elongate central portion 947 of a fastener 800 can be square or nearly any other configuration, rather than being round as shown at 847 in FIG. 8*b*. Additionally, a loop 907 can surround either an open or filled in area 910, and when filled in, the filled portion can include an integrally molded texture providing a user with enhanced friction for a secure grip when fastening or unfastening the fastener 800. Alternatively, the filled section, or perhaps another portion of the fastener, can include either an integrally molded or later applied (e.g., by paint, adhesive sticker, etc.) symbol or other nomenclature providing information to the user (e.g., "This End Out", "Pat. Pending", a maker's trademark, etc.).

As previously mentioned, an elongate fastener typically comprises an elastomeric material capable of elongate expansion and contraction in response to the increasing or decreasing tensile forces applied, for example, by a user when fastening a bathing apparatus 300 into a deployed configuration. Alternatively, an elongate fastener 800 may alternatively be formed of a relatively inelastic material, wherein a compressive force useful for holding the fastener 800 in position in a deployed bathing apparatus 300 is derived from the relatively pliable material of the bath itself, wherein the material of the expanse 400 is compressed by the user when positioning the fastener 800, and expands relatively forcefully against the opposing inner and outer ends 845/846 of the fastener 800 thereafter.

In an embodiment, one or more of the relatively enlarged end portions of a fastener may be slidably (or otherwise movably) arranged along a relatively elongate central portion of a fastener, such as beads slidable along a rod-like member, or washers (e.g., flattened circular band of a relatively rigid material) slidable along a filamentous member, although the embodiments are not so limited. The conceived embodiments likewise include numerous similar assemblies each including a relatively elongate member and two or more enlarged end portions operatively coupled with the elongate member to retain a bathing apparatus in a deployed configuration.

The relatively elongate central portion may extend through an opening provided through each end portion, and the one or more end portions may be either retained on the central portion, or may be removable therefrom. Therefore, in an embodiment, the relatively elongate central portion of a fastener may be inserted through aligned corresponding perforations in an expanse configured for deployment, and the one or more of the end portions can then be assembled to the central portion to securely yet detachably retain the bathing apparatus in a deployed configuration.

Figure 10A:
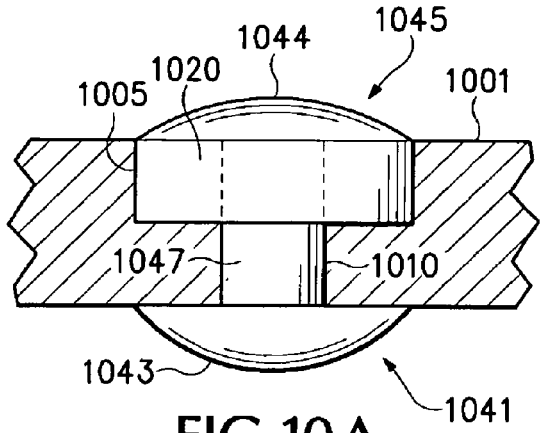
FIG. 10*a* depicts a sectional view of a magnet-actuated fastening means according to an embodiment of the invention.
Figure 10B:
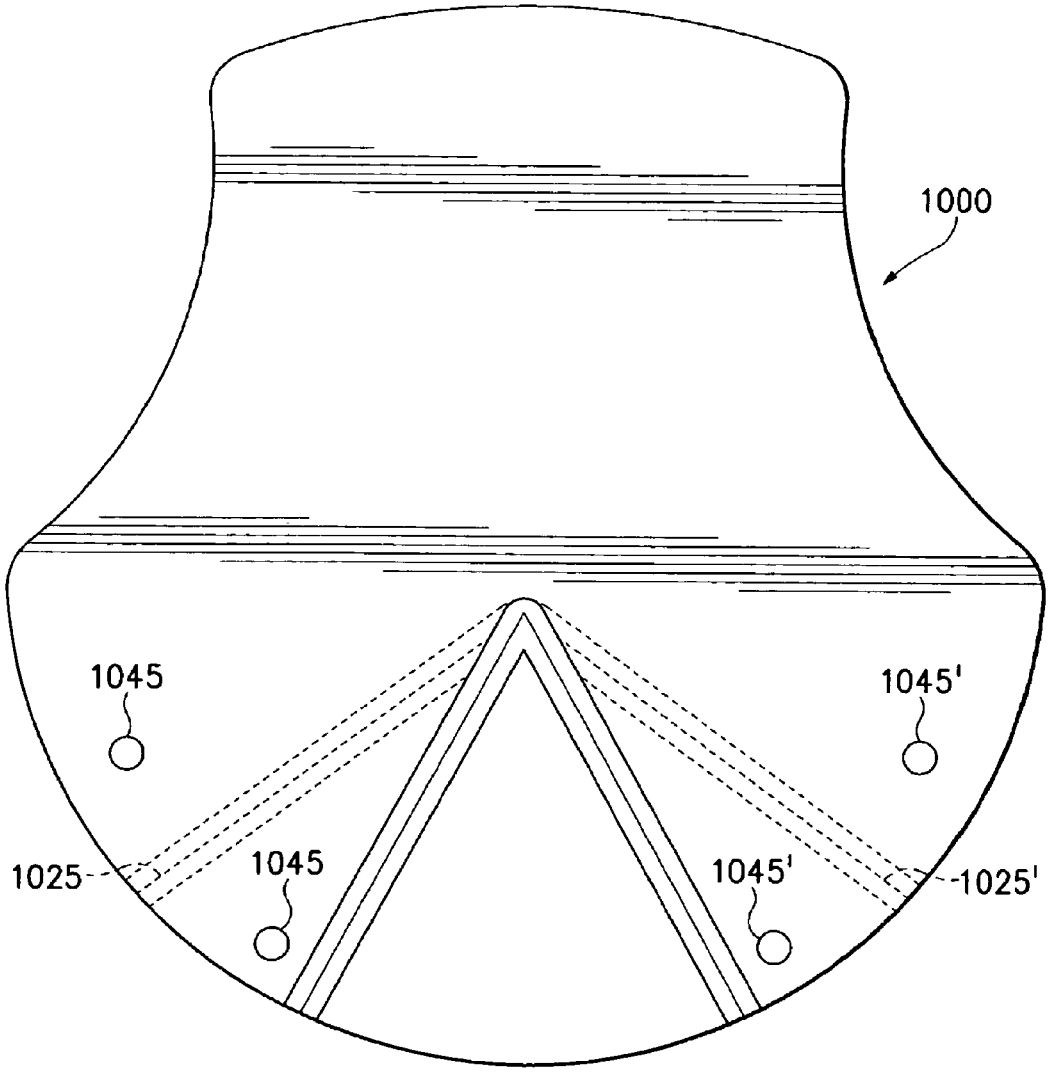
FIG. 10*b* depicts a plan view of a side of a baby bathing apparatus configured for easy storage, according to an embodiment of the invention

Referring to FIGS. 10A-10B, in an exemplary embodiment wherein magnets comprise one or more of the fastening means, one or more magnets 1020 is/are inset into a recess 1005 formed into the material 1001 of the expanse 1000. A recess 1005 is typically, but not exclusively, formed at a location approximately corresponding to perforation 140 shown in FIG. 4. The recess 1005 can be formed during the formation of the expanse 1000, such as by molding, or after formation of the expanse by compression, by excavating material, by incising the material, or by another suitable method. A recess 1005 typically does not pass completely through the full thickness of the expanse, but forms a 'pocket' configured to receive a magnet 1020 in the material expanse, although the embodiments are not so limited.

A recess 1005 typically possesses a depth formed into and measured relative to a surface of the expanse, the depth approximately corresponding to a thickness of a magnet 1020 (or magnets) to be placed therein, and a diameter (or other dimension approximately perpendicular to the depth) approximately corresponding to a diameter (or other non-thickness dimension) of the magnet(s) 1020. A recess 1005 diameter can also be somewhat smaller than a diameter of the magnet 1020. In this later situation, placing a magnet 1020 into the recess 1005 compresses the EVA material (for example) immediately surrounding the recess 1005, and the EVA exerts a reciprocal force upon the magnet 1020, helping to retain the magnet 1020 within the recess 1005.

An exemplary recess 1005 embodiment possesses a flattened cylindrical internal configuration, configured to receive and retain relatively securely a 'donut-shaped' magnet 1020 (e.g., formed as a circular ring about a central void), although the embodiments also encompass alternative corresponding magnet and recess configurations. A recess 1005 can further include a perforation 1010 formed through the material expanse, the perforation 1010 extending from the inner 'floor' of the recess 1005 to the opposing surface of the material expanse. A magnet 1020 having a central void formed therethrough, when positioned within the recess 1005, may encircle an aperture of the perforation 1010 presented within the recess 1005. Therefore, a portion of a retaining structure can be passed through the central void of the magnet 1020 and through the perforation 1010 in the recess 1005, to retain the magnet 1020 relatively securely within the recess 1005. A magnet is retained and/or affixed relatively securely when it typically does not pull out of (e.g., separate from) the material expanse upon application of forces reasonably expected to be applied during deployment, use, and/or stowage of a bathing apparatus described in the embodiments.

A retaining structure 1041 can include, for example, a ratcheting action rivet (rivet) 1041 such as those available from MICRO PLASTICS, INC., having two reciprocal portions configured to couple one with the other (e.g., item numbers 27QB400375N etc.). Each reciprocal rivet portion generally includes a relatively broad head portion 1043/1044 and one or more shaft portions 1047 extending relatively perpendicularly from each head portion 1043/1044. The head portion(s) 1043/1044 are relatively flat on a side proximate the shaft portion(s) 1047, and relatively rounded on a side opposite the shaft portions. The head portion(s) 1043/1044 are also larger in diameter than the perforation 1010 formed through the material expanse at the recess 1005, thus preventing the rivet 1041 portion(s) from being pulled through the perforation 1010 in response to an applied force during reasonably expected use conditions. A shaft portion 1047 of one rivet 1041 portion is configured to engage one or more of the shaft portions of the reciprocal rivet portion, and couple the rivet portions relatively securely together in any of one or more conditions of increasing proximity (and increasing resistance against separation one from another).

As will be understood by one having ordinary skill in the art, ratcheting action rivets are configured to securely engage with materials having a predefined range of thicknesses. Examples of predefined material thickness ranges, accommodated by the design and size of the ratcheting action rivet 1041 portions, include 0.235-0.297 inches, 0.346-0.500 inches, and 0.500-0.780 inches, although the embodiments are not so limited. In embodiments, coupling a magnet 1020 with a material expanse 1000 by a retaining structure will compress the material expanse between and/or immediately surrounding the retaining structure, although other embodiments avoid such compression without affecting performance.

The shaft of a first rivet portion can be passed through the perforation 1010 such that the relatively flat surface of the head 1044 is proximate a surface of the material expanse opposite the recess 1005, and the one or more shaft portions 1047 extends through the perforation 1010 and is exposed within the recess 1005. The shaft 1047 of a reciprocal second rivet portion can be placed in position to relatively co-axially engage the shaft(s) of the first rivet portion, and by applying a force so orientated to bring the relatively parallel-planar flat surfaces of the first and second rivet portion heads 1043-1044 into closer proximity, the shaft portion(s) of the first rivet portion can be caused to engage shaft portion(s) of the second rivet portion.

Although the engaging portions are referred to herein as shaft portions, such description is for exemplary purposes only, and it will be understood that alternative embodiments can include alternatively configured engaging portions. Likewise, alternative retaining structures other than the exemplary ratcheting action rivets, such as any of those discussed above relative to FIG. 6, can be utilized to retain a magnet 1020 partially or fully recessed into a material expanse, or at a surface thereof.

In an embodiment, a relatively strong magnet 1020 (for example, N35 strength) formed at least partially of rare-earth materials (e.g., neodymium) is used, and is typically coated with a corrosion resistant material such as nickel, gold, etc. Such magnets possess substantially stronger holding power than ferritic or ceramic magnets of comparable size, and avoid the electroshock risks of electromagnets in an application including exposure to water.

In embodiments, such as that shown in FIG. 10B, each magnetic fastening means 1045 comprises a complementary magnet pairing, with two or more magnets 1020 positioned at suitable locations relative to the material expanse 1000 at locations on opposite sides of an outer thinned portion 1025/1025'. Thus, when the expanse is flexed at the thinned portion to assume a deployed configuration, the complementary magnetic fastening means 1045 are brought into mutual proximity. Suitable locations for magnets are those locations where the respective magnetic fields of complementary magnets attractively interact when the material expanse is placed in a deployed configuration. Magnets are suitably strong when, upon magnetic engagement of a magnet with a magnetically responsive fastening means, either alone or as a plurality, are capable of retaining the material expanse in a deployed configuration in the absence of extrinsic separation forces (e.g., forces arising from influences separation from the material and components of the bathing apparatus itself).

The respective magnetic fields of the magnetic fastening means 1045 interact one with the other, drawing the magnetic fastening means 1045 into coupling engagement. When so coupled, the adjacent surface portions of the material expanse are likewise drawn together into a confronting arrangement, presenting and securing the material expanse in a deployed (e.g., cupped) configuration substantially as shown in FIGS. 1 and 2. A substantial separation force (e.g., sufficient to overcome the attractive forces of the magnets so coupled) is required to decouple the magnetic fastening means 1045, allowing the material expanse to return to a relatively planar configuration.

Generally, one magnet 1020 having a thickness of approximately 0.6 millimeters (mm.), a diameter of approximately 1.8 mm., and a grade of approximately N35 (or a plurality of magnets collectively providing a comparable magnetic field strength), positioned on each side of a thinned portion 1025/1025' of the expanse to form a magnet pair (e.g., 1045-1045 or 1045'-1045') as shown in FIG. 10*b*, is sufficiently strong to retain the expanse in a deployed configuration. This is, however, only an exemplary embodiment. One having ordinary skill in the art will recognize that magnetic strength (e.g., attractive force exerted upon a material) is a function of numerous parameters of a magnet (e.g., grade, thickness, configuration, etc.) and of the material and/or object attracted, any of which can be varied and/or compensated for by varying another.

In alternative embodiments, a plurality of magnet pairs similarly configured can also be employed along each thinned portion 1025/1025', particularly when one or more magnets 1020 having a lower magnetic field strength are utilized (e.g., ferritic or ceramic magnets, or weaker rare-earth magnets, etc.). Likewise, rather than a pair of magnets, a magnetic fastening means pair can include a relatively stronger magnet 1020 (e.g., stronger than that described in the exemplary embodiment above) in a magnetic fastening means 1045 disposed at one side of a thinned portion 1025/1025', and a magnetically-attractive material (e.g., comprising iron, tin, etc.) coupled with the material expanse and disposed at an opposing side of the thinned portion in a location complementary to the magnet 1020. Whether a magnetically-attractive material or a complementary magnet is used, such can be considered a 'magnetically-responsive' material and/or fastening means, responsive to a first magnetic fastening means.

In alternative embodiments including one or more magnetic fastening means 1045, the magnets 1020 may be coupled with and/or retained in position relative to the material expanse by retaining structures configured to form a magnet-enclosing space between reciprocal portions of the retaining structure, even when the magnet 1020 does not have a void formed therethrough. Therefore, it will be understood that a magnet 1020 can be configured other than 'donut-shaped' in a magnetic fastening means 1045. Alternatively, a retaining structure may adhesively retain a magnet 1020, or be configured to grip a magnet 1020 by a compressive force or by one or more projecting and/or recessed features (e.g., ridges, teeth, detents, grooves, etc.), wherein a magnet 1020 can also include reciprocal features configured to engage and be retained by the projecting and/or recessed features of the retaining structure.

Alternatively, a slot may be cut into the material expanse, and a magnet 1020 inserted into the slot, with the slot then being secured (e.g., glued shut, clipped, etc.), retaining the magnet 1020 within the slot. Although numerous, the descriptions provided herein are for exemplary purposes only, and are not to be construed as limiting the scope of the invention. However, coupled with the expanse, a magnetic fastening means 1045 can be considered to be relatively securely affixed whether coupled utilizing a detachable or relatively permanent retaining structure and/or method. One having ordinary skill in the art will recognize from the descriptions provided herein that nearly any method, compound, or structure than can be used to retain a magnet in a location integral with the material expanse is likewise contemplated within the scope of this invention as reasonable equivalents thereof.

Although numerous configurations, materials, and arrangements of fasteners are described herein, the provided descriptions are for illustrative purposes related to only a small portion of the conceived embodiments within the broader scope of the invention, as would be recognized by one having skill in the art in light of the description, figures, and claims provided herein.

Additionally, although an exemplary embodiment is described herein having four thinned portions enabling conformability of a relatively planar expanse into deployed configuration as a baby bathing apparatus, alternative embodiments are also contemplated which include more numerous thinned portions, as well as fewer or none at all. Likewise, although the thinned portions of the exemplary embodiment of, for example FIGS. 4 and 5, terminate at a relatively common central seat portion of a bathing apparatus, the thinned portions may not all extend so far inward, and may deviate toward other portions of the bathing apparatus in alternative embodiments. Also, not all thinned portions need extend entirely to a periphery of a front portion in an alternative embodiment.

The contemplated embodiments likewise include an arrangement and/or assembly of a plurality of individual bathing apparatus elements, mechanically and/or adhesively coupled with a membrane, sheet, layer, or other similar expanse of material to form a relatively planar expanse configurable for deployment as a baby bathing apparatus. The elements so configured may collectively comprise similar and/or identical materials, configurations, dimensions, and properties, or any one or combination thereof, or an element may differ from at least one other element in any one or combination thereof.

In light of the drawings and descriptions provided herein, one having ordinary skill in the art will recognize that embodiments of the invented bathing apparatus provides numerous benefits not present in the art.

For example, embodiments of the bathing apparatus are easy to transport and store as a relatively planar expanse (sheet), rather than consisting of a large, rigid, permanently formed bathtub as currently dominates the art. In fact, embodiments of a bathing apparatus described herein typically, but not exclusively, include no rigid structural elements.

Embodiments of the bathing apparatus comprise a suitably pliable, cushioning, slip-resistant, thermally insulating material, providing a comfortable and safe surrounding structure for a baby during bathing. Materials such as those described herein (e.g., EVA) possess all or a substantial portion of the beneficial properties listed here. However, the materials that may be used according to embodiments are not so limited, and may include nearly any materials providing all or some portion of such beneficial properties. For example, embodiments are described herein which use natural materials (e.g., bamboo, bundled grasses, etc.), enabling use of an embodiment of the invented bathing apparatus where such material are plentiful and economically obtainable, and where perhaps an embodiment formed of EVA or a substantially similar material functionally may not be easily available, or may not meet a user's environmental preferences.

The configuration of embodiments of the bathing apparatus fit easily yet securely within a basin, and retain a baby in a safe, relatively upright reclining position. Typically, embodiments of the invented bathing apparatus hold a baby sufficiently securely that a care giver can typically use both hands to bath a baby, rather than requiring one hand to hold the baby in position.

Embodiments of the invention can be configured to retain varying amounts of water during bathing, or provide for no water retention at all. Likewise, the embodiments generally are water resistant, easy to clean, quick to dry, and may include anti-pathogen, anti-fungal, and/or other features to help maintain a baby's good health.

Therefore, it will be understood that the present invention is not limited to the method or detail of construction, fabrication, material, application or use described and illustrated herein. Indeed, any suitable variation of fabrication, use, or application is contemplated as an alternative embodiment, and thus is within the spirit and scope, of the invention.

It is further intended that any other embodiments of the present invention that result from any changes in application or method of use or operation, configuration, method of manufacture, shape, size, or material, which are not specified within the detailed written description or illustrations contained herein yet would be understood by one skilled in the art, are within the scope of the present invention.

Accordingly, while the present invention has been shown and described with reference to the foregoing embodiments of the invented apparatus, it will be apparent to those skilled in the art that other changes in form and detail may be made therein without departing from the spirit and scope of the invention as defined in the appended claims.

We claim:

1. Baby bathing apparatus, comprising:

an expanse including a central region, a peripheral region, and a wedge-shaped peripheral take-up region defined by opposing edges meeting at a vertex within the central region, the expanse in a stowable mode of the apparatus assuming a generally planar shape; and fastener means couplable with the opposing edges, the fastener means urging the opposing edges into confrontation with one another and urging the central region of the expanse concavely inwardly in a deployable mode of the apparatus into an inverted cone-shape, the inverted cone-shape when deployed having each of a relatively continuously curved outer surface-configured to fit within a sink and a relatively continuously curved inner surface configured to support a baby for bathing therein.

2. The apparatus of claim 1, wherein the wedge-shaped take-up region comprises one selected from the group consisting of a material expanse contiguous with the expanse and a non-material opening.

3. An apparatus configured to rest at least partially within a wash basin and to safely retain an infant, comprising:

a sheet of substantially flexible material including a wedge-shaped peripheral portion delineated by a plurality of relatively linear hinge elements, wherein one end of each of the plurality of hinge elements collectively terminate at a position somewhat short of the relative center of the sheet and wherein another end of each of the hinge elements extends approximately to a periphery of the sheet;

a peripheral gusseted portion positioned within and operatively coupled with the wedge-shaped portion via the plurality of hinge elements and configured to enable deforming the sheet into a relatively cupped configuration having relatively continuously curved inner and outer surfaces;

one or more fastening means each configured to operatively and detachably couple with either two separate portions of the sheet or with the sheet and the gusseted portion, and to retain the sheet in the cupped configuration.

4. The apparatus of claim 3, wherein the gusseted portion is configured to depart from a common plane with a surface expanse of the sheet when the sheet is deformed into a relatively cupped configuration.

5. The apparatus of claim 3, wherein at least one of the one or more fastening means comprises an elongate, elastomeric member having at least a first end and a second end separated by a central portion, and wherein at least the first end of the fastening means is configured with an enlarged cross-sectional dimension relative to the central portion providing secure purchase when gripped by a human hand, and wherein at least the second end is configured with an enlarged cross-sectional dimension relative to the cross-sectional dimension of the central portion.

6. The apparatus of claim 3, further comprising:

a first perforation formed through the sheet from a first surface to a second opposing surface of the sheet and configured to enable an enlarged portion of a fastening means to be forcibly inserted through the perforation from the first surface of the sheet to the second opposing surface of the sheet, and to detachably retain the enlarged portion proximate the second surface.

7. The apparatus of claim 6, further comprising:

a second perforation formed through the gusseted portion positionally corresponding to the first perforation in the sheet and traversing a hinged element of the gusseted portion such that a relatively narrow central portion of the fastening means can pass bi-directionally through the perforation at the hinged element when the hinged element is substantially fully flexed, and configured such that when so engaged, the fastening means securely and detachably retains the hinged element in the substantially fully flexed condition.

8. The apparatus of claim 3, wherein the sheet comprises an ethylene-vinyl acetate (EVA) closed-cell foam material having a relatively uniform thickness in a range of approximately 0.5-5 centimeters.

9. The apparatus of claim 3, which, when deformed into a relatively parabolic configuration, is retainable substantially within a wash basin, and is further configured to receive and securely retain an infant wherein the infant's buttocks rest within a relatively concave vertex of the relatively cupped sheet, and wherein each of the infant's torso, head, and feet are held at a relatively elevated position with respect to the infant's buttocks.

10. The apparatus of claim 3, wherein at least a surface of the sheet configured to face a baby during bathing comprises a relatively non-slippery surface texture when wet.

11. The apparatus of claim 3, wherein at least one of the one or more fastening means is a magnetic fastening means comprising a suitably strong magnet relatively securely affixed at a suitable portion of either the sheet or the gusseted portion, and configured to operatively couple with a complementary magnetically-responsive fastening means relatively securely affixed at a suitable complementary portion of the other of the sheet or the gusseted portion.

12. The apparatus of claim 3, wherein the sheet comprises a plurality of laterally juxtaposed individual elongate segments sequentially and flexibly coupled one with another, wherein each segment is relatively articulable with respect to each adjacently coupled segment, and wherein the sheet comprises a configuration selected from the group consisting of:

the plurality of elongate segments radiating outward from a relatively central region of the sheet, wherein one or more of the elongate segments comprise each of the wedged-shaped peripheral portion and the gusseted portion when configured for deployment, the plurality of elongate segments being collectively and pivotably coupled at a first end of the plurality, and collectively and pivotably coupled at a second end of the plurality, wherein a relatively central portion of each elongate segment is coupled with a corresponding portion of each adjacent segment via a flexible member, and wherein the relatively central portion of each elongate segment is laterally separable from each adjacent elongate segment, and each of the respective first end and second end of each elongate segment remains closely coupled with the respective first end and second end of each adjacent segment, and the plurality of elongate segments comprising a subset of a larger plurality of segments collectively and operably coupled with a flexible expanse of material, and collectively configurable as a relatively concave bathing apparatus.

13. A baby bathing apparatus, comprising:

an expanse of suitably dense and pliable polymeric material, the expanse having a suitable and relatively uniform first thickness, the expanse comprising:

a relatively planar inner surface;

a relatively planar outer surface opposing and relatively planar parallel with respect to the inner surface;

an upper body support portion generally comprising one end of the expanse and a lower body retaining portion comprising an end of the expanse opposite the upper body support portion, a longitudinal center line extending throughout the expanse from an upper periphery of the upper body support portion to a lower periphery of the lower body retaining portion, the longitudinal center line dividing the expanse into opposing left and right halves;

a plurality of relatively linear thinned portions each having a first end, the collective first ends terminating at a position approximately corresponding to the longitudinal center line approximately two-fifths of the length from the lower periphery to the upper periphery, and each having a second end terminating at a periphery of the lower body retaining portion, and comprising:

a first thinned portion on the left half of the expanse and a second opposing thinned portion on the right half of the expanse, the first and second thinned portions extending outward from the longitudinal center line at an angle in a range between approximately 20-90 degrees relative to the longitudinal center line, and each of the first and second thinned portions being impressed into the inner surface and having a second thickness approximately one-quarter of the first thickness of the expanse, and a third thinned portion on the left half of the expanse and a fourth opposing thinned portion on the right half of the expanse, the third and fourth thinned portions extending outward from the longitudinal center line at an angle approximately evenly bisecting the expanse between the longitudinal center line and the first and second thinned portions respectively, each of the third and fourth thinned portions being impressed into the outer surface and having a third thickness approximately one-quarter of the first thickness of the expanse, wherein the third and fourth thinned portions define a relatively triangular central wedge of the expanse, and the first and third thinned portions define a relatively triangular left wedge of the expanse, and the second and fourth thinned portions define a relatively triangular right wedge of the expanse, and wherein the third and fourth thinned portions function as live hinges allowing the inner surfaces of the left wedge and the right wedge, respectively, to fold inwardly upon the inner surface of the central wedge; and one or more fastening means operatively coupled with one or both of the left and right halves of the expanse and configured to operatively couple with one or both of the left wedge and the central wedge and to retain the inner surface of the left wedge proximate the inner surface of the central wedge, and to operatively couple with one or both of the right wedge and the central wedge and to retain the inner surface of the right wedge proximate the inner surface of the central wedge, the the one or more fastening means being configured when operatively coupled to cause the inner and outer surfaces of the expanse to each assume a relatively continuously curved configuration.

14. The apparatus of claim 13, further configured such that, upon folding the left and right wedges inwardly upon the central wedge, the first and second thinned portions are drawn into close proximity to one another proximate the longitudinal center line of the inner surface, and the outer surfaces of each of the left and right wedges are drawn into close proximity with a respective adjacent outer surface of the expanse, and wherein the expanse compliantly deflects inwardly to form approximately an inverted cone-shape.

15. The apparatus of claim 13, wherein a portion of one or both of the inner surface and the outer surface of the expanse comprises a relatively slip-resistant texture.

16. The apparatus of claim 14, further comprising a plurality of perforations extending through the expanse from the inner surface to the outer surface, the perforations comprising one or more selected from the group consisting of, one or more first perforations formed proximate the upper periphery of the upper body support portion and configured to enable suspending the expanse from a cantilevered structure inserted through the perforation, one or more second perforations formed through the central wedge and positioned to permit drainage of a liquid retained within the inverted cone-shape when such liquid exceeds a level corresponding to a distance between the one or more second perforations and the common convergence position of the plurality of thinned portions, one or more third perforations formed through either or both of the left half proximate a left periphery of the expanse and the right half proximate a right periphery of the expanse relatively intermediate the upper periphery of the upper body support portion and the lower periphery of the lower body support portion, one or more fourth perforations formed through either or both of the left and right halves of the expanse proximate the respective first and second thinned portions and configured to receive and detachably couple with an end portion of the one or more fastening means, and one or more fifth perforations formed through either or both of the left wedge and central wedge proximate the third thinned portion, and through either or both of the right wedge and central wedge proximate the fourth thinned portion.

17. The apparatus of claim 13, wherein the polymeric material comprises a closed-cell ethylene-vinyl acetate (EVA).

18. The apparatus of claim 13, wherein each of the one or more fastening means comprise an elongate member including a center portion having a relatively narrow cross-section and respective first and second end portions, each of the first and second end portions configured with a laterally enlarged cross-section relative to the central portion.

19. The apparatus of claim 18, wherein the one or more fastening means comprise an elastomeric material enabling resilient lengthening of the fastening means during operative and detachable coupling with one or more of the left wedge, the right wedge, and the central wedge.

20. The apparatus of claim 13, wherein at least one of the one or more fastening means comprises one or more magnetic fastening means configured to magnetically-couple with one or more complementary magnetically-responsive fastening means.

21. The apparatus of claim 13, wherein a portion of the periphery of either or both of the left and right halves deviates progressively inwardly at least partially toward the longitudinal center line from each of a relatively upper and lower portion of said periphery.

22. The apparatus of claim 13, wherein the expanse has a thickness within a range of approximately 0.5-5 centimeters other than at the thinned portions.

23. A method of forming a three-dimensional infant bathing receptacle from a relatively flexible and flat sheet of material, comprising:

providing a bilaterally-symmetrical expanse of flexible material, the expanse having a relatively narrow end opposite a relatively wider end;

providing linear, thinned portions of the expanse extending to a central region of the sheet approximately two-fifths of the distance between the relatively wider end and the relatively narrow end and diverging at opposing angles of approximately forty-five degrees relative to a longitudinal center of the bilaterally symmetrical expanse and extending approximately to a periphery of the relatively wider end;

providing reciprocal gusseted means intermediate the two thinned portions and configured to depart from co-planarity with and depend from the expanse when flexing the gusseted means at the thinned portions, wherein flexing the gusseted means at the thinned portions enables the thinned portion to be drawn together into close proximity one with the other and causing the expanse to assume a relatively bowl-like shape having relatively continuously curved inner and outer surfaces; and providing one or more fastening means configured to securely yet detachably retain the expanse in said bowl-like configuration.

24. The method of claim 23, wherein the flexible material comprises an ethylene-vinyl acetate material formed as a relatively planar expanse with a relatively uniform thickness in a range of 0.5-5 centimeters.

25. The method of claim 23, wherein the fastening means comprise one or more elongate members, one or more of which include a relatively cross-sectionally small linear central portion and one or more relatively cross-sectionally larger end portions.

26. The method of claim 23, further comprising:

forming a plurality of perforations through a full thickness of the expanse, one or more of the plurality of perforations configured to receive and detachably retain an end portion of a fastening means, and another of the plurality of configured to receive and detachably retain another end of the fastening means, the retained fastening means maintaining the expanse in the bowl-like configuration.

27. The method of claim 23, further comprising:

providing a water-retention limiting means comprising a perforation formed through a full thickness of the expanse and selectively positioned inwardly from a periphery of the expanse a distance corresponding to a pre-determined maximum water depth.

28. The method of claim 23, wherein the one or more fastening means includes at least one complementary pair of magnetic fastening means comprising at least one magnet and at least one magnetically-responsive material.

29. An infant bathing apparatus, comprising:

a relatively planar expanse comprising a plurality of laterally juxtaposed elongate segments sequentially and flexibly coupled one to another wherein each segment can articulate relative to one or more adjacent segments, and wherein articulating a first segment of the plural segments of the expanse so that a portion of the first segment overlies a portion of a second segment of the plural segments causes the expanse to assume a relatively concave configuration with an inner vertex located approximately at a relatively central region of the expanse; and a first fastening means coupled with the first segment and a second fastening means coupled with the second segment, wherein the first and second fastening means are configured to detachably engage with one another, and when so engaged, to retain the expanse in the relatively concave configuration.

30. The apparatus of claim 29, further comprising:

a hinge-like structure comprising an intrusion formed into the flexible material and extending inwardly from a periphery of the expanse, the intrusion being disposed between a portion of the first segment and a portion of the second segment.

31. The apparatus of claim 29, further comprising:

a perforation formed through the expanse proximate an end of at least one of the plural segments, wherein the perforation is configured to permit insertion of a projecting object therethrough.

32. The apparatus of claim 29, wherein the expanse comprises an integrally formed sheet of a flexible polymeric material, wherein the sheet includes a relatively planar first surface and an opposing relatively planar parallel second surface, and wherein the sheet further has a substantially uniform thickness found within the range of approximately five-tenths to five (0.5-5.0) centimeters.

* * * * *

UNITED STATES PATENT AND TRADEMARK OFFICE

CERTIFICATE OF CORRECTION

PATENT NO. : 8,250,684 B2
APPLICATION NO. : 12/229827
DATED : August 28, 2012
INVENTOR(S) : Benjamin Todd Richardson It is certified that error appears in the above-identified patent and that said Letters Patent is hereby corrected as shown below:

In the Claims:

Column 24, in Claim 13,
at line 16, replace “the the” with --the--.

Column 26, in Claim 26,
at line 9, replace “of configured” with --of perforations configured--.

Signed and Sealed this
Eighteenth Day of December, 2012

David J. Kappos

David J. Kappos
*Director of the United States Patent and Trademark Office*